US012297022B2

(12) United States Patent
McCandless et al.

(10) Patent No.: US 12,297,022 B2
(45) Date of Patent: May 13, 2025

(54) INSERT WITH UNDERCUTS

(71) Applicant: Altria Client Services LLC, Richmond, VA (US)

(72) Inventors: Todd M. McCandless, Richmond, VA (US); Brian M. Casey, Richmond, VA (US); Christopher L. Simpson, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 17/947,348

(22) Filed: Sep. 19, 2022

(65) Prior Publication Data

US 2024/0092549 A1 Mar. 21, 2024

(51) Int. Cl.

| | |
|---|---|
| ***B65D 75/32*** | (2006.01) |
| ***B65D 5/20*** | (2006.01) |
| ***B65D 5/30*** | (2006.01) |

(52) U.S. Cl.

CPC ..... *B65D 75/327* (2013.01); *B65D 5/2057* (2013.01); *B65D 5/307* (2013.01); *B65D 2575/3227* (2013.01)

(58) Field of Classification Search

CPC ..... B65D 75/36; B65D 2585/56; B65D 2575/3227; B65D 5/307; B65D 5/2057; B65D 75/327

USPC ..... 206/531, 461–471, 703

See application file for complete search history.

(56) References Cited

U.S. PATENT DOCUMENTS

| | | | |
|---|---|---|---|
| D35,615 | S | 1/1902 | Stecher |
| 1,009,804 | A | 11/1911 | Sugarman |
| D94,062 | S | 12/1934 | Wilsdon |
| 3,037,684 | A | 6/1962 | Andrews et al. |
| 3,202,280 | A | 8/1965 | Larson |
| 3,393,794 | A | 7/1968 | Borin |
| D214,879 | S | 8/1969 | Roccaforte et al. |
| D218,677 | S | 9/1970 | Biallo |
| D219,266 | S | 11/1970 | Biallo |
| D221,626 | S | 8/1971 | Fine |
| D227,552 | S | 7/1973 | Bridges |

(Continued)

FOREIGN PATENT DOCUMENTS

| | | |
|---|---|---|
| EP | 0007423 A1 | 2/1980 |
| EP | 0615913 A1 | 9/1994 |

(Continued)

OTHER PUBLICATIONS

Office Action dated Oct. 3, 2023, issued in related Japanese Design Patent Application No. 2023-005329.

(Continued)

*Primary Examiner* — Chun Hoi Cheung

(74) *Attorney, Agent, or Firm* — Harness, Dickey & Pierce, P.L.C.

(57) ABSTRACT

The insert includes a base, the base including at least one depression that defines a cavity, the at least one depression including a floor with walls, the walls including a first pair of opposing walls and a second pair of opposing walls, the first pair of opposing walls each defining an undercut, the undercut including a lower inclined segment and an upper inclined segment that join at an apex, the apex of the undercut for each of the first pair of opposing walls facing each other, and a lid connected to an upper brim of the base, the lid covering the cavity.

37 Claims, 21 Drawing Sheets

(56) References Cited

U.S. PATENT DOCUMENTS 3,759,371 A * 9/1973 Marks ..... B65D 75/327 206/484
3,861,583 A 1/1975 Tingley et al.
D234,252 S 2/1975 Gerson
3,921,804 A * 11/1975 Tester ..... B65D 83/0463 206/515
4,062,486 A 12/1977 Goodrich
D250,748 S 1/1979 Leger
4,614,297 A 9/1986 Davis et al.
4,679,693 A 7/1987 Forman
4,773,542 A 9/1988 Schillinger et al.
D303,722 S 9/1989 Marlow et al.
4,917,288 A 4/1990 Heitele et al.
4,949,841 A 8/1990 Focke et al.
5,014,855 A 5/1991 Roccaforte
5,018,625 A 5/1991 Focke et al.
5,123,589 A 6/1992 Cote
5,184,725 A 2/1993 Reinheimer et al.
5,190,155 A 3/1993 Grunwald
5,325,963 A 7/1994 Focke et al.
5,358,171 A 10/1994 Focke
5,390,792 A * 2/1995 Van Ness ..... A61L 2/26 206/439
5,462,223 A 10/1995 Focke et al.
D365,023 S 12/1995 Abrams et al.
5,511,722 A 4/1996 Dixon
5,560,490 A * 10/1996 Chawla ..... B65D 75/327 206/530
D387,976 S 12/1997 Mori
5,791,478 A * 8/1998 Kalvelage ..... B65D 75/327 206/539
5,934,475 A * 8/1999 Hikake ..... B41J 2/17533 206/461
D415,958 S 11/1999 Noble
5,975,415 A 11/1999 Zehnal
D419,062 S 1/2000 Feldmeier et al.
D434,319 S 11/2000 Mori
D434,652 S 12/2000 Mori
D441,497 S 5/2001 Focke et al.
D443,760 S 6/2001 DeGrandpré et al.
6,279,819 B1 8/2001 Schultz
D448,888 S 10/2001 Focke et al.
6,334,532 B1 1/2002 Tambo et al.
6,364,115 B1 * 4/2002 Casanova ..... B65D 75/36 206/471
6,427,841 B2 * 8/2002 Wani ..... B65D 75/36 206/806
D465,416 S 11/2002 Dzwill et al.
D468,638 S 1/2003 Nogami et al.
6,564,945 B1 * 5/2003 Weinstein ..... A61J 1/03 206/459.5
6,604,676 B2 8/2003 Giblin
D484,046 S 12/2003 Kopecky
D487,532 S 3/2004 Draghetti et al.
D503,087 S 3/2005 Dzwill et al.
6,988,619 B2 * 1/2006 Klatt ..... A61J 1/035 206/499
D522,742 S 6/2006 Priebe
D531,498 S 11/2006 Fluegel et al.
7,178,712 B2 2/2007 Schultz et al.
D542,649 S 5/2007 Sagel et al.
D543,452 S 5/2007 Gehring et al.
D545,188 S 6/2007 Billig et al.
D553,494 S 10/2007 Dehlin
7,353,940 B2 4/2008 Sendo
D579,325 S 10/2008 Bray et al.
D579,768 S 11/2008 Kirk et al.
D579,769 S 11/2008 Lipinski et al.
D584,141 S 1/2009 Smith et al.
D584,944 S 1/2009 Kirk et al.
D594,323 S 6/2009 Friedman et al.
D594,596 S 6/2009 Mitten et al.
D596,305 S 7/2009 Usui et al.
D597,418 S 8/2009 Stojek
D598,785 S 8/2009 Stojek
D599,654 S 9/2009 Kosaka et al.
D601,747 S 10/2009 Tabrah
D601,748 S 10/2009 Pipes et al.
D607,318 S 1/2010 Collins
D610,303 S 2/2010 Valle
D614,045 S 4/2010 Gaudenzi et al.
D616,146 S 5/2010 Holford
D616,250 S 5/2010 Peyton et al.
7,717,260 B2 5/2010 Buse
7,717,319 B2 5/2010 Adam
D618,545 S 6/2010 Toinet et al.
7,731,024 B2 6/2010 Bouno et al.
D619,454 S 7/2010 Fluegel et al.
D620,812 S 8/2010 Gaudenzi et al.
D624,401 S 9/2010 Friedman et al.
D628,090 S 11/2010 Stuiber et al.
D635,456 S 4/2011 Yan
D637,090 S 5/2011 Stuiber et al.
D642,482 S 8/2011 Stuiber et al.
D642,483 S 8/2011 Stuiber et al.
D644,100 S 8/2011 Stacy-Ryan
8,016,105 B2 9/2011 Sendo
D647,395 S 10/2011 Mitten et al.
8,051,983 B2 * 11/2011 Simon ..... B65D 50/06 206/532
8,061,586 B2 11/2011 Fluegel et al.
D649,885 S 12/2011 Stuiber et al.
D652,322 S 1/2012 Stuiber et al.
D654,358 S 2/2012 Ampadu et al.
8,123,030 B2 2/2012 Hein
D655,153 S 3/2012 Mitten et al.
D655,623 S 3/2012 Mehren et al.
D655,624 S 3/2012 Mehren et al.
D655,625 S 3/2012 Mehren et al.
D655,626 S 3/2012 Mehren et al.
D655,627 S 3/2012 Mehren et al.
D655,628 S 3/2012 Mehren et al.
D660,142 S 5/2012 Kirk et al.
D665,250 S 8/2012 Kirk et al.
D665,251 S 8/2012 Kirk et al.
D675,917 S 2/2013 Holford
8,393,469 B2 3/2013 Aldridge et al.
D680,882 S 4/2013 Logue
D681,442 S 5/2013 Kengla
D681,479 S 5/2013 Logue
D686,090 S 7/2013 Logue
D686,913 S 7/2013 Kirk et al.
D693,964 S 11/2013 Loyd
D695,103 S 12/2013 Kirk et al.
D698,141 S 1/2014 Priebe et al.
D701,756 S 4/2014 Chen
D702,134 S 4/2014 Hjalmarsson
D706,129 S 6/2014 Boraczek et al.
8,875,878 B2 11/2014 Young
9,004,273 B2 4/2015 Tanbo
D734,169 S 7/2015 Harper
D734,170 S 7/2015 Harper
D739,766 S 9/2015 Glass et al.
D743,247 S 11/2015 Solovov, Jr. et al.
D746,673 S 1/2016 Sanfilippo et al.
D779,339 S 2/2017 Stronski
D789,782 S 6/2017 Kahawaiolaa et al.
D801,803 S 11/2017 Mitten et al.
D803,043 S 11/2017 Greenspan
D804,964 S 12/2017 Bennett
D813,028 S 3/2018 Saito et al.
D816,507 S 5/2018 Xie et al.
D821,866 S 7/2018 Scotti
D823,107 S 7/2018 Sanfilippo et al.
D829,092 S 9/2018 Bandiera
D834,409 S 11/2018 Banacki
D850,905 S 6/2019 Mitten et al.
D856,146 S 8/2019 McKenzie et al.
10,407,208 B2 9/2019 Mitten et al.
D861,478 S 10/2019 Binder
D866,311 S 11/2019 Ito
D866,312 S 11/2019 Ito
D874,921 S 2/2020 Zhao

(56) References Cited

U.S. PATENT DOCUMENTS

| | | | | |
|---|---|---|---|---|
| D876,963 | S | 3/2020 | Bloom et al. | |
| D886,638 | S | 6/2020 | Bhalla et al. | |
| D891,273 | S | 7/2020 | Atalay | |
| D895,958 | S | 9/2020 | Guo et al. | |
| D898,345 | S | 10/2020 | Lee | |
| D901,294 | S | 11/2020 | McGrath | |
| D902,054 | S | 11/2020 | Bhalla et al. | |
| D903,939 | S | 12/2020 | Tung | |
| D904,878 | S | 12/2020 | Lee et al. | |
| D904,879 | S | 12/2020 | Lee et al. | |
| D905,549 | S | 12/2020 | McGrath | |
| D917,168 | S | 4/2021 | Tung | |
| D918,029 | S | 5/2021 | Reaux | |
| D927,062 | S | 8/2021 | Partouche | |
| D933,353 | S | 10/2021 | Chen | |
| D952,473 | S | 5/2022 | Hanzly et al. | |
| D956,551 | S | 7/2022 | Altman | |
| D966,697 | S | 10/2022 | Chen | |
| D966,698 | S | 10/2022 | Chen | |
| 2004/0188315 | A1 | 9/2004 | Morita et al. | |
| 2007/0228130 | A1 | 10/2007 | Arai | |
| 2008/0152264 | A1 | 6/2008 | Pokusa et al. | |
| 2009/0101536 | A1 | 4/2009 | Bitner | |
| 2009/0200182 | A1 | 8/2009 | Post-Smith et al. | |
| 2009/0230013 | A1* | 9/2009 | Born | A61J 7/0084 206/534 |
| 2010/0065459 | A1 | 3/2010 | Tsao | |
| 2010/0170941 | A1 | 7/2010 | Mitra-Shah et al. | |
| 2011/0132794 | A1 | 6/2011 | Ingraham | |
| 2011/0233106 | A1 | 9/2011 | Fluegel et al. | |
| 2012/0111746 | A1 | 5/2012 | Tanbo et al. | |
| 2012/0199640 | A1 | 8/2012 | Thorne et al. | |
| 2012/0291401 | A1 | 11/2012 | Mitten et al. | |
| 2013/0306511 | A1 | 11/2013 | Branyon et al. | |
| 2013/0319886 | A1 | 12/2013 | Ledermann | |
| 2014/0311930 | A1 | 10/2014 | Buse et al. | |
| 2016/0229620 | A1 | 8/2016 | Steinkamp et al. | |
| 2016/0368645 | A1 | 12/2016 | Buse | |
| 2017/0088341 | A1 | 3/2017 | Fallon et al. | |
| 2017/0197778 | A1 | 7/2017 | Slooff | |
| 2017/0283150 | A1 | 10/2017 | Petrucci et al. | |
| 2018/0362247 | A1 | 12/2018 | Slooff | |
| 2018/0370716 | A1 | 12/2018 | Draghetti et al. | |
| 2019/0002187 | A1 | 1/2019 | Kahawaiolaa et al. | |
| 2019/0002188 | A1 | 1/2019 | Rudolf et al. | |
| 2019/0002190 | A1 | 1/2019 | Cailleaux | |

FOREIGN PATENT DOCUMENTS

| | | | |
|---|---|---|---|
| EP | 1588633 | A1 | 10/2005 |
| EP | 1739021 | A1 | 1/2007 |
| EP | 3388364 | A1 | 10/2018 |
| GB | 90056087000005 | | 8/2018 |
| JP | 1513288 | S | 12/2014 |
| JP | 1529419 | S | 7/2015 |
| JP | 1658266 | S | 4/2020 |
| JP | 1688145 | S | 6/2021 |
| JP | 1732025 | S | 12/2022 |
| JP | 1757315 | S | 11/2023 |
| KR | 20010034368 | A | 4/2001 |
| KR | 20130002699 | U | 5/2013 |
| WO | WO-2012/048671 | A2 | 4/2012 |
| WO | 2015088744 | A1 | 6/2015 |

OTHER PUBLICATIONS

Oversize Cardboard Countertop Bin. Date first available: Jan. 16, 2017. Site visited: Nov. 30, 2023. Available online: https://www.displays2go.com/P-13713/Oversize-Cardboard-Countertop-Bin-19-125-x-12-94-d-Corrugated-Pocket (Year: 2017).

One-Piece Tuck Top Candy Boxes. Date first available: 2020. Site visited: Nov. 30, 2024. Available online: https://www.papermart.com/p/one-piece-tuck-top-candy-boxes/20565 (Year: 2020).

Altria Pouch Product: Announced (Jun. 3, 2019; online). Site Visited (Jan. 10, 2024). Available from URL: https://www.businesswire.com/news/home/20190603005428/en/.

Lookah Load VV510 Thread Battery: Site Visited (Jan. 10, 2024). Available from URL: https://truewholesale.com/collections/battery-mods/products/lookah-load-w-510-thread-battery-pop-of-25?.

Office Action dated Mar. 27, 2023, issued in related Korean Design Patent Application No. 30-2023-0010041.

Office Action dated Mar. 27, 2023, issued in related Korean Design Patent Application No. 30-2023-0010044.

Office Action dated Mar. 28, 2023, issued in related Korean Design Patent Application No. 30-2023-0010024.

International Search Report and written opinion for PCT/EP2017/066218 dated Sep. 4, 2017.

Notice of Allowance issued Jan. 24, 2019 in U.S. Appl. No. 29/625,136.

Office Action issued Feb. 28, 2017 in U.S. Appl. No. 29/569,608.

Office Action issued Jul. 6, 2018 in U.S. Appl. No. 15/196,406.

Canadian Office Action, dated Jun. 26, 2024, issued in Canadian Patent Application No. 220100.

Canadian Office Action, dated Jun. 26, 2024, issued in Canadian Patent Application No. 220097.

Office Action, dated May 9, 2024, issued in U.S. Appl. No. 29/853,748.

Office Action, dated May 9, 2024, issued in U.S. Appl. No. 29/853,746.

Notice of Allowance, dated Aug. 29, 2024, issued in U.S. Appl. No. 29/853,746.

Notice of Allowance, dated Aug. 27, 2024, issued in U.S. Appl. No. 29/853,738.

Notice of Allowance, dated Aug. 30, 2024, issued in U.S. Appl. No. 29/853,748.

Canadian Office Action, dated Jun. 18, 2024, issued in Canadian Patent Application No. 220094.

Canadian Office Action, dated Oct. 1, 2024, issued in Canadian Patent Application No. 220100.

Canadian Office Action, dated Oct. 1, 2024, issued in Canadian Patent Application No. 233844.

International Search Report and Written Opinion, dated Dec. 13, 2023, issued in International Patent Application No. PCT/US2023/074554.

Canadian Office Action, dated Oct. 8, 2024, issued in Canadian Patent Application No. 220097.

Notice of Allowance issued Jan. 21, 2025 in U.S. Appl. No. 29/853,748.

Notice of Allowance issued Jan. 21, 2025 in U.S. Appl. No. 29/853,738.

Notice of Allowance issued Jan. 23, 2025 in U.S. Appl. No. 29/853,746.

Japanese Appeal Decision issued Mar. 18, 2025 in Japanese Design Application No. 2023-005329.

International Preliminary Report on Patentability mailed Apr. 3, 2025 in International Patent Application No. PCT/US2023/074554.

* cited by examiner

INSERT WITH UNDERCUTS

BACKGROUND

Field

Example embodiments generally relate to an insert with undercuts that oppose each other.

Description of Related Art

Packages can store and dispense consumables that may degrade and lose freshness when exposed to ambient air.

SUMMARY

At least one example embodiment is directed toward an insert.

In at least one example embodiment, the insert includes a base, the base including at least one depression that defines a cavity, the at least one depression including a floor with walls, the walls including a first pair of opposing walls and a second pair of opposing walls, the first pair of opposing walls each defining an undercut, the undercut including a lower inclined segment and an upper inclined segment that join at an apex, the apex of the undercut for each of the first pair of opposing walls facing each other; and a lid connected to an upper brim of the base, the lid covering the cavity.

In at least one example embodiment, the lower inclined segment is a first arcuate-shaped segment that is inclined to extend upward and further into a central-portion of the cavity, and the upper inclined segment is inclined to extend upward and further away from the central-portion of the cavity.

In at least one example embodiment, each of the first pair of opposing walls includes a second arcuate-shaped segment that connects the upper inclined segment of the undercut to the upper brim, the second arcuate-shaped segment extending upward and further away from the central-portion of the cavity.

In at least one example embodiment the lower inclined segment defines a first interior surface of the at least one depression that is concave, the upper inclined segment defines a second interior surface of the at least one depression that is flat, and the second arcuate-shaped segment defines a third interior surface of the at least one depression that is convex.

In at least one example embodiment, a crease is defined along an inner surface of the at least one depression at a seam between the upper inclined segment and the second arcuate-shaped segment.

In at least one example embodiment, major interior surfaces of the first pair of opposing walls is flared outward, from the floor of the at least one depression to the upper brim of the base, such that the first pair of opposing walls are closest together at the floor.

In at least one example embodiment, the first pair of opposing walls is longer than the second pair of opposing walls.

In at least one example embodiment, the at least one depression has a horizontal cross-sectional shape that is rectangular.

In at least one example embodiment, the undercut for each of the first pair of opposing walls extends from an upper portion of each of the first pair of opposing walls into the cavity.

In at least one example embodiment, the undercut for each of the first pair of opposing walls runs along half of a first length of each of the first pair of opposing walls.

In at least one example embodiment, the base includes a first flat major surface on the upper brim of the base, the lid including a second flat major surface, at least a portion of the second flat major surface being at least partially connected to the first flat major surface.

In at least one example embodiment, the base includes a first flat major surface on the upper brim of the base, the lid including a second flat major surface, the second flat major surface covering and being connected to the first flat major surface.

In at least one example embodiment, the lid includes a weakened area, the weakened area being at least partially above the cavity.

In at least one example embodiment, the weakened area is a thinned portion of the lid.

In at least one example embodiment, the weakened area is defined at least in part by perforation lines in the lid.

In at least one example embodiment, the cavity is configured to contain a consumer product, and the at least one depression is configured to be pressed toward the lid to push the consumer product through the weakened area to release the consumer product from the insert.

In at least one example embodiment, the base is made from a thermoform plastic, and the walls of the at least one depression have a thickness of 0.4 mm to 0.6 mm.

In at least one example embodiment, the base is made from polyethylene terephthalate, and the walls of the at least one depression have a thickness of 0.5 mm.

In at least one example embodiment, each one of the first pair of opposing walls has a lower corner that is rounded, the lower corner being connected to the floor of the at least one depression.

In at least one example embodiment, the lower inclined segment is arcuate-shaped, the first pair of opposing walls defining opposing concave interior surfaces of the at least one depression, each one of the opposing concave interior surfaces including an inner surface of the lower inclined segment and the lower corner.

In at least one example embodiment, the opposing concave interior surfaces are configured to securely hold side surfaces of a consumer product.

In at least one example embodiment, the first pair of opposing walls are flared outward away from each other from a lowest elevation to a highest elevation of the at least one depression, such that the first pair of opposing walls are closest to each other at the floor of the at least one depression.

In at least one example embodiment, the first pair of opposing walls are flared outward away from each other from a lowest elevation to a highest elevation of the at least one depression, such that the first pair of opposing walls are closest to each other at the floor of the at least one depression, and the second pair of opposing walls are flared outward away from each other from the lowest elevation the highest elevation of the at least one depression, such that the second pair of opposing walls are closest to each other at the floor of the at least one depression.

In at least one example embodiment, the at least one depression includes a plurality of depressions.

In at least one example embodiment, the insert further includes a cartridge contained within the at least one depression.

In at least one example embodiment, an upper surface of an upper end of the cartridge is at a first elevation that is higher than a second elevation of the apex of the undercut for each of the first pair of opposing walls.

In at least one example embodiment, the cartridge has a maximum width that spans between a respective one of the first pair of opposing walls, the apex of the first pair of opposing walls being separated by a first distance, the maximum width being larger than the first distance.

In at least one example embodiment, the first distance is at least 90% of the maximum width.

In at least one example embodiment, the cartridge has a first horizontal cross-section with a rectangular shape and a first vertical cross-section with opposing convex outer sidewalls, the opposing convex outer sidewalls being in direct contact with at least a portion of the first pair of opposing walls of the at least one depression, the maximum width existing in a plane that traverses through a mid-section of the opposing convex outer sidewalls of the cartridge.

In at least one example embodiment, the cartridge has a first horizontal cross-section with a rectangular shape and a first vertical cross-section with opposing convex outer sidewalls, the opposing convex outer sidewalls being in direct contact with at least a portion of the first pair of opposing walls of the at least one depression.

In at least one example embodiment, the cartridge is free-floating in a first direction within the at least one depression, the first direction being perpendicular to interior surfaces of the second pair of opposing walls.

In at least one example embodiment, the cartridge has a second vertical cross-section that is perpendicular to the first vertical cross-section, the second vertical cross-section having second opposing sidewalls that are flat, the cartridge being free-floating in a first direction within the at least one depression such that both of the second pair of opposing walls are not in direct contact with the second opposing sidewalls at a same time.

In at least one example embodiment, the first pair of opposing walls defines opposing lower concave interior surfaces the at least one depression, the floor and the opposing lower concave interior surfaces of the at least one depression is in direct contact with lower portions of the cartridge.

In at least one example embodiment, the lower portions of the cartridge include side surfaces and a lower surface of the cartridge that are at or below a mid-section of the cartridge, the mid-section being in a plane that passes through a maximum width of the cartridge, the maximum width spanning between the first pair of opposing walls.

In at least one example embodiment, the lower inclined segment of the undercut is in direct contact with upper portions of the cartridge, the upper portions including upper side surfaces of the cartridge that are at or above the mid-section of the cartridge.

In at least one example embodiment, upper interior surfaces of the first pair of opposing walls, other than the lower inclined segment, are spaced apart and do not directly contact the upper portions of the cartridge.

At least one example embodiment is directed toward a package.

In at least one example embodiment, the package includes a plurality of inserts; and an outer box containing the plurality of inserts.

In at least one example embodiment, a cartridge contained within the at least one depression of each of the plurality of inserts.

In at least one example embodiment, the outer box includes an opening that is re-closeable, the outer box being configured to allow each one of the plurality of inserts to be slideably removed from outer box through the opening.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
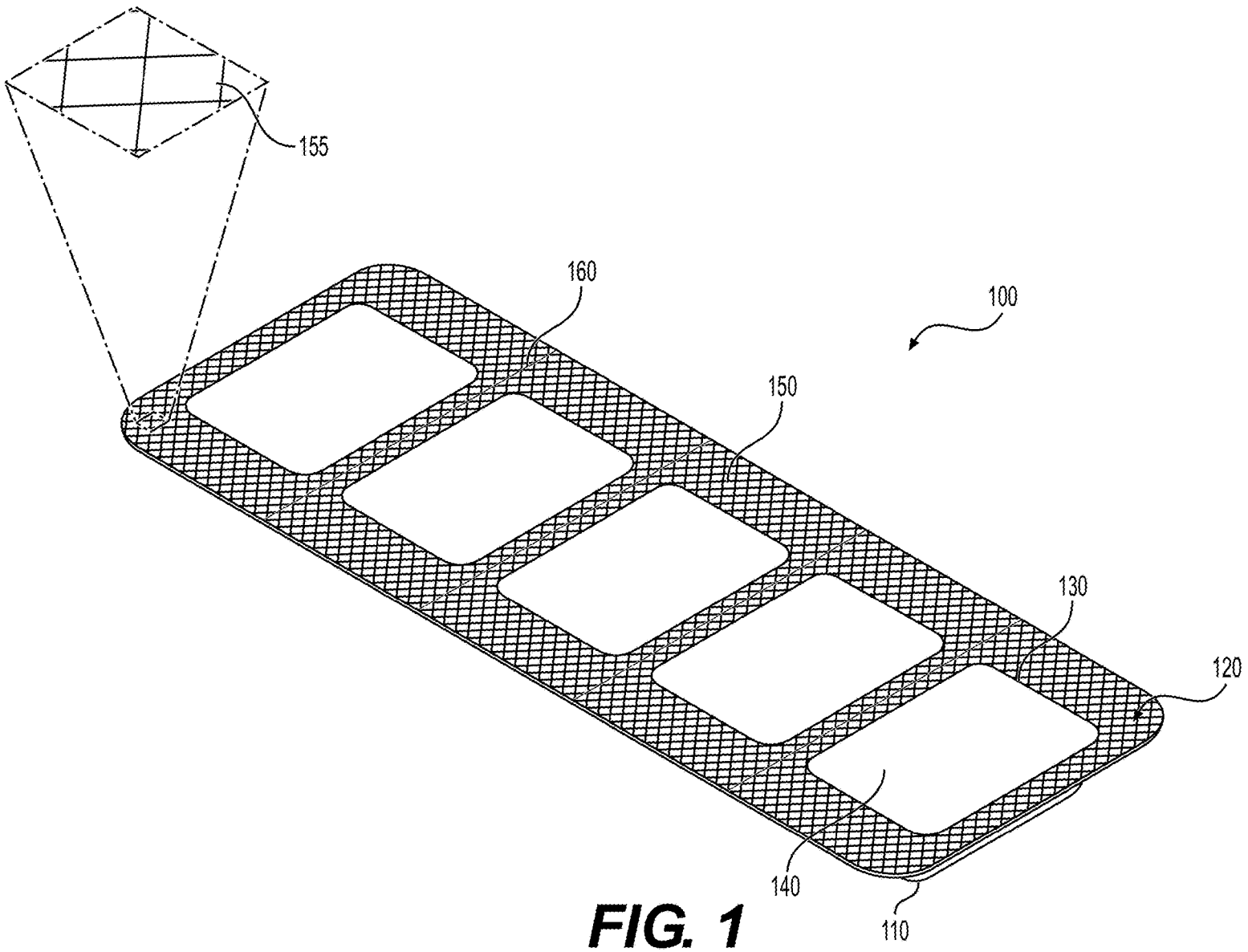
FIG. 1 is an illustration of a perspective view of an insert, in accordance with at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the words "about" and "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Figure 2:
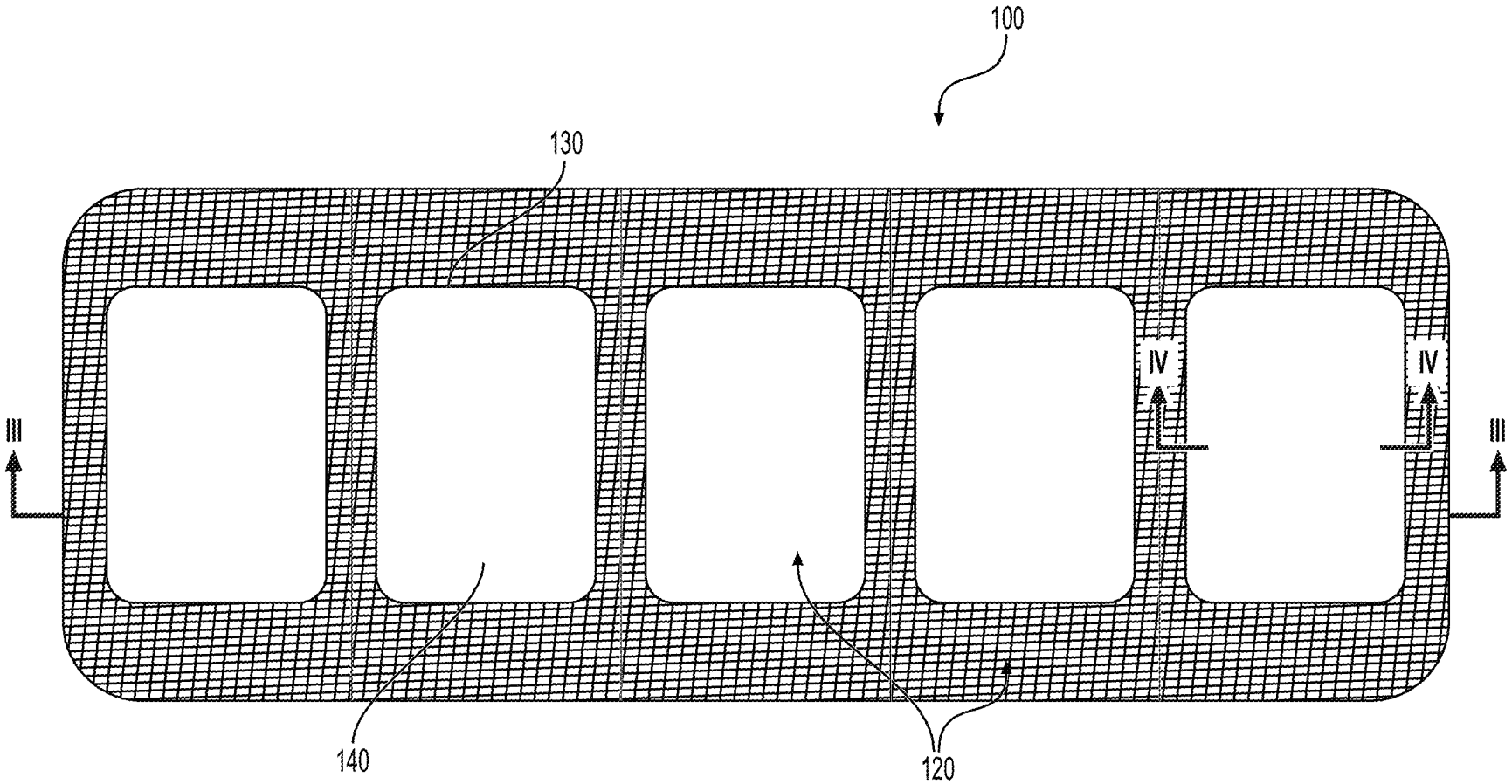
FIG. 2 is an overhead view of the insert, in accordance with at least one example embodiment.
Figure 3:
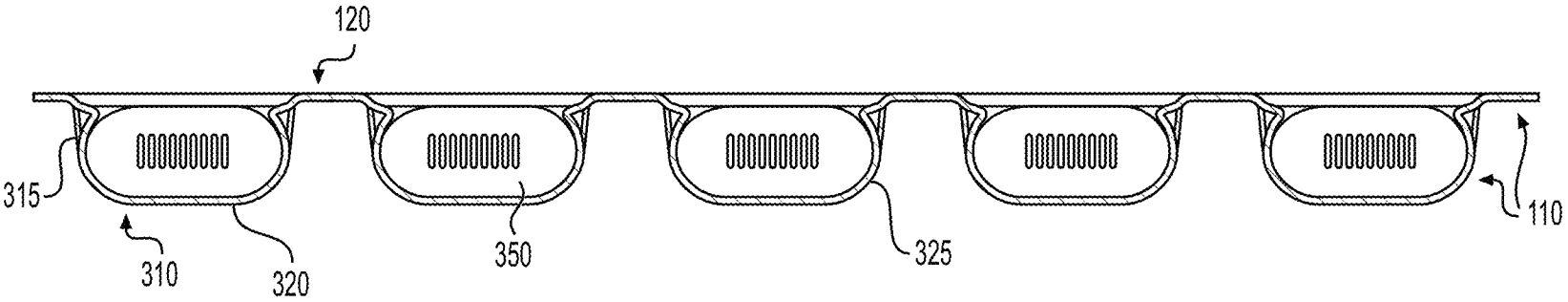
FIG. 3 is a vertical cross-section of the insert, in accordance with at least one example embodiment.

FIG. 1 is an illustration of a perspective view of an insert 100, in accordance with at least one example embodiment. FIG. 2 is an overhead view of the insert 100, in accordance with at least one example embodiment. FIG. 3 is a cross-section of the insert 100 (view III-III), in accordance with at least one example embodiment.

In at least one example embodiment, the insert 100 includes a base 110 and a lid 120. In at least one example embodiment, the lid 120 is connected to the base 110. In at least one example embodiment, the lid 120 covers a top end of the base 110. In at least one example embodiment, the base 110 defines depressions 310 that contain consumer products 350 (see at least FIG. 3). In at least one example embodiment, each one of the depressions 310 contains a single one of the consumer products 350. In at least one example embodiment, each one of the depressions contains more than one of the consumer products 350. In at least one example embodiment, each of the depressions 310 includes a floor (lower surface) 320, rounded corners 325 and sidewalls 315 that hold and cradle one of the consumer products 350.

In at least one example embodiment, the consumer product 350 is an e-vaping element. In at least one example embodiment, the consumer product 350 is a cartridge, as described and shown in more detail in relation to FIGS. 8A-8D. In at least one example embodiment, the consumer product 350 is a heat-not-burn element or device, a hybrid element (including tobacco or a tobacco extract with a pre-vapor formulation reservoir), an element with a tobacco plug, etc.

As shown in FIGS. 1 and 2 (and as further shown in FIG. 4B), in at least one example embodiment the lid 120 includes weakened areas 140. In at least one example embodiment, the weakened areas 140 allow at least portions of the lid 120 to be relatively easily penetrated or torn, at least in these areas, to release the consumer product 350 from the depressions 310 (see at least FIG. 4B). In at least one example embodiment, the weakened areas 140 are above each one of the depressions 310, or above at least a portion of each of the depressions 310. In at least one example embodiment, the weakened areas 140 may include a single weakened area that spans across at least a portion of each of the depressions 310. In at least one example embodiment, the weakened areas 140 are thinned portions of the lid 120, from a standpoint that the lid 120 is made from a thinner layer of material in these areas. In at least one example embodiment, a border 130 of the weakened areas 140 may assist or cause the weakened areas 140 to be weakened. In at least one example embodiment, the border 130 is perforated, scored or embossed to assist in causing the weakened areas 140 to be penetrated or at least partially torn. In at least one example embodiment, the weakened areas 140 are made from a different material relative to a remainder, or at least some portions, of the lid 120.

In at least one example embodiment, the lid 120 includes reinforced areas 150. In at least one example embodiment, the reinforced areas 150 are areas of the lid 120 that are not the weakened areas 140. In at least one example embodiment, the reinforced areas 150 are areas that are one of corrugated, ribbed, thickened, or combinations thereof. In at least one example embodiment, the reinforced areas include grooves 155 that provide durability or strength to the lid 120. In at least one example embodiment, the reinforced areas 150 are made from a different material, relative to the weakened areas 140, or relative to other portions of the lid 120. In at least one example embodiment, the reinforced areas 150 of the lid 120 are made from cardboard, foil, paper, paperboard, high density polyethylene (HDPE), low density polyethylene (LDPE), polyethylene terephthalate (PET), polypropylene (PP), or combinations thereof. In at least one example embodiment, the lid 120 is made from a material that is recyclable. In at least one example embodiment, the weakened areas 140 are made from a different material that is less durable or less strong, relative to the reinforced areas 150. In at least one example embodiment, the weakened areas 140 are made from a foil, and the reinforced areas 150 are made from a layer or layers of material, or stronger or harder material, relative to the foil. In at least one example embodiment, the layers or the layer of material, or the stronger or harder material, may or may not also include foil. In at least one example embodiment, either or both of the weakened areas 140 and the reinforced areas 150 are made from the layers or the layer of material, or a composite of different materials. In at least one example embodiment, the weakened areas 140 are a same material as the reinforced areas 150.

In at least one example embodiment, a divider line 160 is defined across a width of the lid 120 at locations that are between the depressions 310. In at least one example embodiment, the divider lines 160 are formed during a manufacturing process. In at least one example embodiment, the divider lines 160 are perforated, scored or embossed lines that forms lines of weakness that may allow individual sections of the insert 100 to be removed from a remainder of the insert 100 (also see discussion related to FIG. 5A).

Figure 4A:
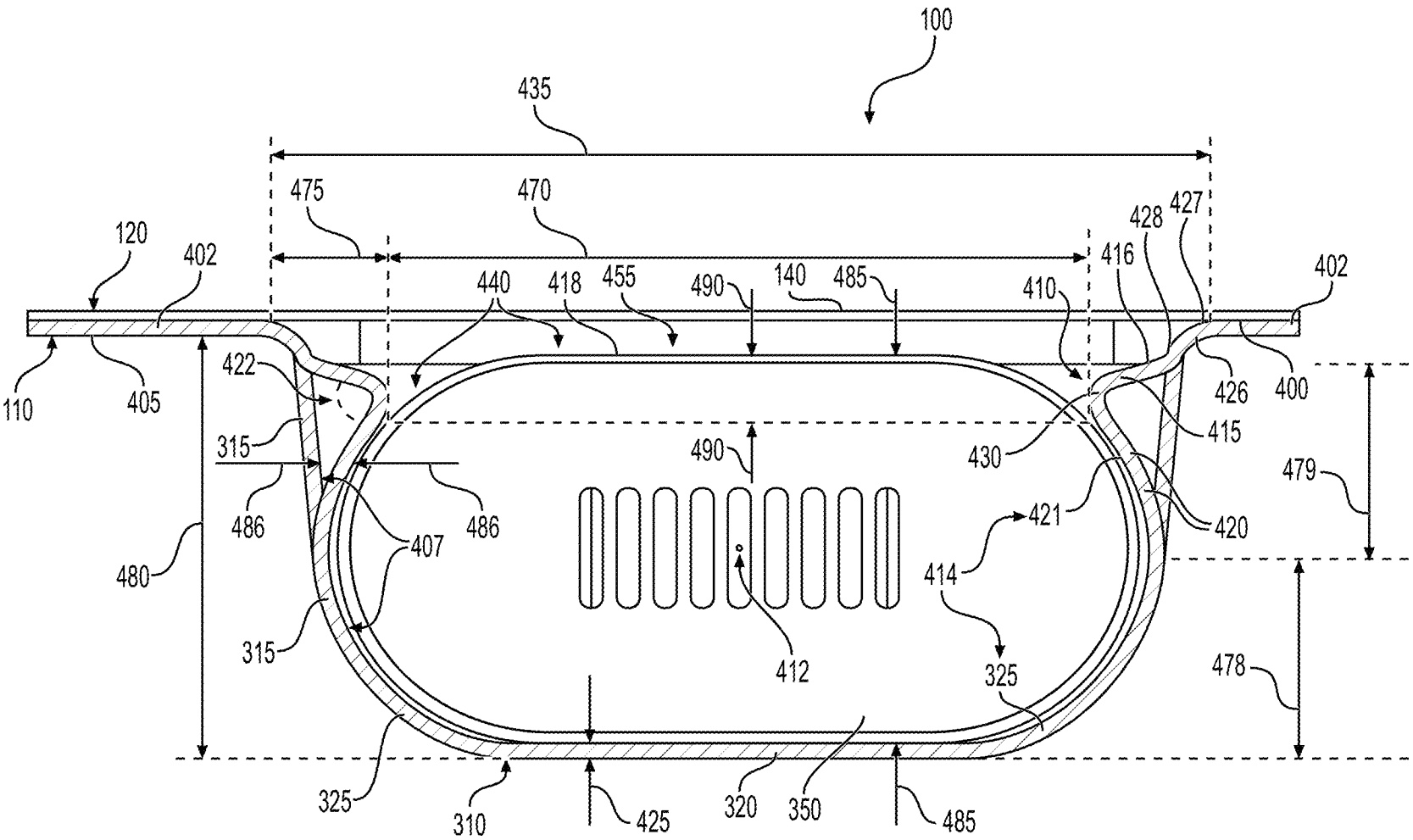
FIG. 4A is a magnified view of a portion of a vertical cross-section of a portion of an insert, in accordance with at least one example embodiment.
Figure 4B:
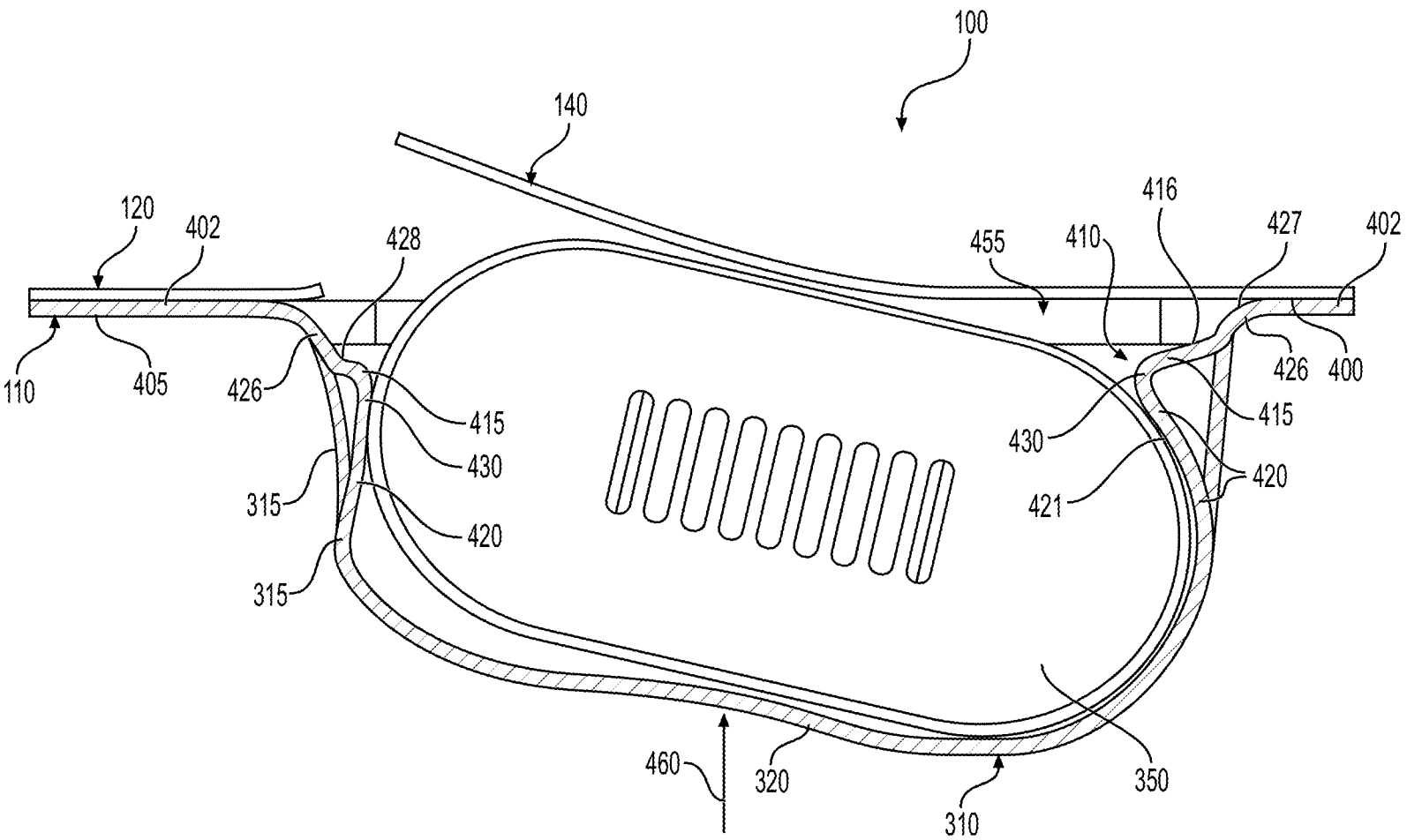
FIG. 4B is a magnified view of a portion of the vertical cross-section of a portion of an insert, in accordance with at least one example embodiment.
Figure 4C:
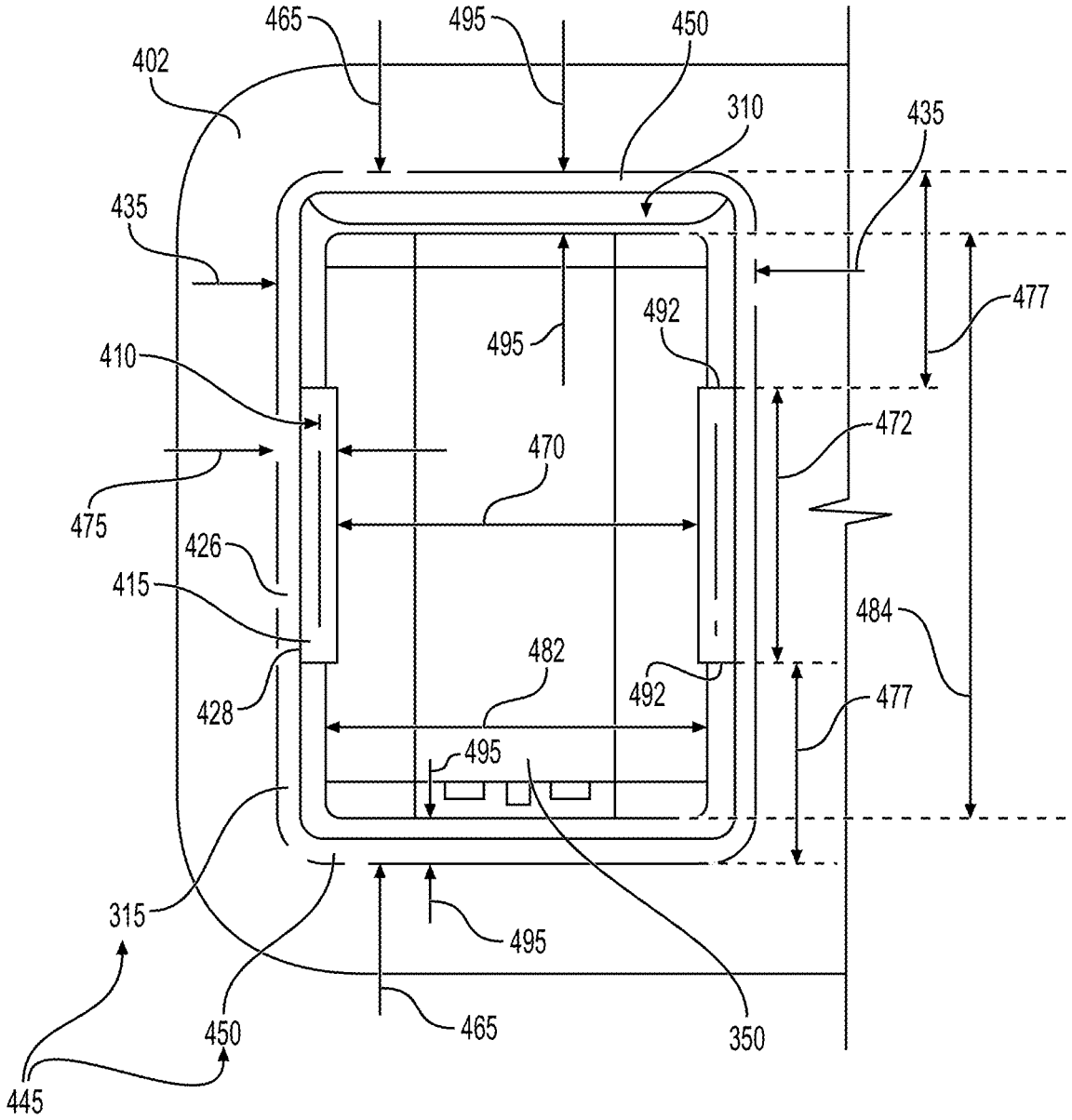
FIG. 4C is a magnified, overhead view of a portion of the insert, in accordance with at least one example embodiment.

FIG. 4A is a magnified view of a portion of a vertical cross-section (View IV-IV) of a portion of the insert 100, in accordance with at least one example embodiment. FIG. 4B is a magnified view of a portion of the vertical cross-section (View IV-IV) of a portion of the insert 100, in accordance with at least one example embodiment. FIG. 4C is a magnified, overhead view of a portion of the insert 100, in accordance with at least one example embodiment.

In at least one example embodiment, each one of the depressions 310 defines a cavity 455 which contains the consumer product 350. In at least one example embodiment, walls 445 (sidewalls 315 and end-walls 450) of the depressions 310 extend from a lower surface (second flat major surface) 405 of an upper brim 402 of the insert 100 to define each of the cavities 455. In at least one example embodiment, the walls 445 of each of the depressions 310 are conformed to a shape of the consumer product 350. In at least one example embodiment, an undercut 410 is defined by an upper portion of each one of the sidewalls 315, where each one of the undercuts 410 at least partially grips and securely cradles the consumer product 350. In at least one example embodiment, the undercuts 410, the walls 445 and the floor 320 of each of the depressions 310 collectively cradle and conform to a shape of the consumer product 350 to reduce an overall headspace 440 (a volume of open space) within the cavities 455, to assist in a reduction of oxygen that may be exposed to the consumer product 350 during a storage, shipment and sale of the consumer product 350 prior to use, as further discussed herein. In at least one example embodiment, the undercuts 410, the walls 445 and the floor 320 of the depressions 310 are conformed to a shape of the consumer product 350 to reduce a cost and an amount of packaging materials for protecting the consumer product 350.

In at least one example embodiment, the base 110 includes the upper brim 402 with an upper surface (first major surface) 400 that is flat or substantially flat. In at least one example embodiment, the lid 120 lies over at least a portion of the upper surface 400, and fully covers each of the cavities 455. In at least one example embodiment, each one of the cavities 455 includes a pair of the undercuts 410, where the undercuts 410 are on opposing sides of the consumer product 350. In at least one example embodiment, each one of the undercuts 410 includes a lower inclined segment 420 and an upper inclined segment 415 that are joined at an apex 430. In at least one example embodiment, the lower inclined segment 420 is an arcuate-shaped segment (wall portion), that is inclined to extend upward and away from a central-portion (center) 412 of the cavity 455. In at least one example embodiment, the lower inclined segment 420 defines an interior surface 421 that is concave. In at least one example embodiment, each of the depressions 310 defines concave interior surfaces 414 that oppose each other to grip the consumer product 350, where the concave interior surfaces 414 include the interior surface 421 of the lower inclined segment 420 and an interior surface of the rounded corners 325. In at least one example embodiment, the upper inclined segment 415 is an inclined segment that extends upward and further away from the central-portion 412 of the cavity 455. In at least one example embodiment, the upper inclined segment 415 defines an interior surface 416 that is flat or substantially flat.

In at least one example embodiment, the apex 430 of each of the pairs of the undercuts 410 oppose each other and face each other within each of the cavities 455. In at least one example embodiment, the upper inclined segment 415 is connected to the upper brim 402 via an arcuate-shaped segment 426. In at least one example embodiment, the arcuate-shaped segment 426 extends upward and away from the central-portion 412 of the cavity 455, where an interior surface 427 of the arcuate-shaped segment 426 is convex. In at least one example embodiment, a crease 428 is defined between the arcuate-shaped segment 426 and the upper inclined segment 415.

In at least one example embodiment, the walls 445 of the depressions 310, and the undercuts 410, are made of a firm but malleable and/or resilient material. In at least one example embodiment, and as shown in FIG. 4B, the floor 320 and the walls 445 of the insert 100 may be pushed upward, by a pressing force 460, in order to free the consumer product 350 from the insert 100. In at least one example embodiment, once the pressing force 460 is applied to the floor 320, the floor 320 and the walls 445 are deformed (crumpled) and one or both of the undercuts 410 are deformed and forced outward to allow the consumer product 350 to be forced through the lid 120, or forced through the weakened area 140, so that the consumer product 350 can be extracted from the cavity 455. In at least one example embodiment, the convex shape of the arcuate-shaped segment 426, in conjunction with the angle 422 of the apex 430 that is formed by a position of the lower inclined segment 420 in relation to the upper inclined segment 415, assist in allowing the undercut 410 to resiliently spring back into a resting position (FIG. 4A), following a deformation of the undercut 410 (FIG. 4B). In at least one example embodiment, due to the resiliency of the undercuts 410, a spent one of the consumer products 350 may be re-inserted into the cavity 455 (see FIG. 5F) to dispose and/or recycle the insert 100 and/or the consumer product 350.

In at least one example embodiment, major interior surfaces 407 of the sidewalls 315 are flared outward, from the floor 320 to the upper brim 402 of the insert 100. Therefore, in at least one example embodiment, the sidewalls 315 that are opposing each other for each of the depressions 310 are closest together at the floor 320, and the major interior surfaces 407 of the sidewalls 315 are a furthest apart at the upper brim 402. In at least one example embodiment, an upper portion of the sidewalls 315 (near the upper brim 402), other than the lower inclined segment 420 which is defined by the sidewalls 315, is spaced apart from an upper portion of the consumer product 350 to allow the consumer product 350 to more easily be extracted from the insert 100.

In at least one example embodiment, the base 110 is made from a thermoform plastic that is heated and then molded or extruded during a manufacturing process. In at least one example embodiment, the base 110 is made from high density polyethylene (HDPE), low density polyethylene (LDPE), polyethylene terephthalate (PET), polypropylene (PP), or combinations thereof. In at least one example embodiment, the base 110 is made from a material that is recyclable. In at least one example embodiment, a thickness 425 of the base 110, or at least a thickness of the walls 445, the floor 320 and the undercut 410, is about 0.1 mm to 1 mm, or about 0.3 mm to 0.7 mm, or about 0.4 mm to 0.6 mm, or about 0.5 mm. In at least one example embodiment, a thickness 425 of the base 110, or at least a thickness of the walls 445, the floor 320 and the undercut 410, is about 0.1 mm to 1 mm, or about 0.3 mm to 0.7 mm, or about 0.4 mm to 0.6 mm, or about 0.5 mm, and the base 110 is made from polyethylene terephthalate (PET). In at least one example embodiment, the thickness 425 of the base 110, or at least a thickness of the walls 445, the floor 320 and the undercut 410, impact a performance of the base 110 from a manufacturing and a resiliency standpoint, as the thickness 425 of the base 110 should not be too thin to avoid holes forming in the base 110 during a thermoform manufacturing process, and the thickness 425 should not be too large to ensure the base 110 is malleable and resilient during a use of the base 110. In at least one example embodiment, the thickness 425 of the base 110 is a same thickness for each of the floor 320, the walls 445 of the depression 310, the undercut 410 and the upper brim 402.

In at least one example embodiment, and as shown in at least FIG. 4C, each of the depressions 310 has a rectangular shaped footprint (rectangular shaped horizontal cross-section). In at least one example embodiment, a longitudinal length 465 of each of the depressions 310 is longer than a width 435 of the depressions 310. In at least another example embodiment, the footprint of the depressions 310 are square shaped. Other shapes for the footprint of the depressions 310 are contemplated. In at least one example embodiment, a combined gap 495 exists between ends of the consumer product 350 and the end-walls 450 of the depression 310. In at least one example embodiment, a longitudinal length 484 of the consumer product 350 is shorter than a longitudinal length 465 of the depression 310. In at least one example embodiment, the consumer product 350 can freely-float between the end-walls 450 (due to the gap 495). In at least one example embodiment, the undercuts 410 contact the consumer product 350, but still allow the consumer product 350 to freely-float within the depression 310 between end-walls 450. In at least one example embodiment, the consumer product 350 is free-floating in a direction that is perpendicular to interior surfaces of the end-walls 450. In at least one example embodiment, the free-floating movement of the consumer product 350 along the longitudinal length 484 of the depression 310 allows the consumer product 350 to more easily be pressed (via the pressing force 460) and angled to force the consumer product 350 out of the depression 310. In at least one example embodiment, the sidewalls 315 of the depression 310, and the undercuts 410, cradle and hold the consumer product 350 firmly enough that the consumer product 350 is not able to slide or shift along a width 435 of the depression 310 (see FIGS. 4A and 4C). That is to say, in at least one example embodiment, the consumer product 350 cannot freely-float between the sidewalls 315.

In at least one example embodiment, the floor 320 and the sidewalls 315 directly contact and cradle the consumer product 350 at least along a lower elevation 478 of the consumer product 350. In at least one example embodiment, the undercuts 410 directly contact and cradle the consumer product 350 at least along an upper elevation 479 of the consumer product 350 (see FIG. 4A). In at least one example embodiment, the lower elevation 478 constitutes a lower half of the consumer product 350, and the upper elevation 479 constitutes an upper half of the consumer product 350. In at least one example embodiment, the floor 320, the sidewalls 315 and/or the undercut 410 directly contact and cradle the consumer product 350 up to an upper end 490 of the consumer product 350. In at least one example embodiment, the upper end 490 of the consumer product 350, or at least an upper surface 418 of the consumer product 350, extends above an elevation of the apex 430 of the undercuts 410.

In at least one example embodiment, the undercuts 410 run along at least a portion of the longitudinal length 465 of the depression 310 on the sidewalls 315 (FIG. 4C). In at least one example embodiment, the undercuts 410 run along a mid-section of the sidewalls 315, such that a gap 477 exists between an end-surface 492 of the undercut and the end-wall 450.

In at least one example embodiment, a longitudinal length 472 of the undercuts 410 is about 10 mm to 6 mm, or about 8 mm. In at least one example embodiment, the length 472 of the undercuts 410 are about 30% to 60% of the longitudinal length 465 of the depression 310, or about 40% of the longitudinal length 465 of the depression 310. In at least one example embodiment, the length 472 of the undercuts 410 is about half the longitudinal length 465 of the depression 310. In at least one example embodiment, the undercuts 410 run along an entirety of the longitudinal length 465 of the depression 310, such that the undercuts 410 span the full distance between the end-walls 450.

In at least one example embodiment, and as shown in FIGS. 4A and 4C, a height (thickness) 485 of the consumer product 350 is about 4 mm to 8 mm, or about 6 mm. In at least one example embodiment, the longitudinal length 484 of the consumer product 350 is about 15 mm to 20 mm, or about 17.5 mm. In at least one example embodiment, a maximum width 482 of the consumer product 350 is about 10 mm to 15 mm, or about 12.4 mm. In at least one example embodiment, a width (distance) 470 between the apex 430 of the undercuts 410 is about 9 mm to 15 mm, or about 10 mm to 12.5 mm, or about 11.35 mm (see FIGS. 4A and 4B). In at least one example embodiment, the width 470 between the apex 430 of the undercuts 410 is about 85% to 95% of the maximum width 482 of the consumer product 350, or about 90% of the maximum width 482 of the consumer product 350. In at least one example embodiment, the width 470 between the apex 430 of the undercuts 410 is greater than 90% of the maximum width 482 of the consumer product 350. In at least one example embodiment, a width 475 of each one of the undercuts 410 is about 0.5 mm to 1.5 mm, or about 0.8 mm to 1.3 mm, or about 1.2 mm (FIGS. 4A and 4C). In at least one example embodiment, a width 475 of each one of the undercuts 410 is 1.5 mm or less. In at least one example embodiment, the width 475 of each one of the undercuts 410 is about 3.5% to 15% of the maximum width 482 of the consumer product 350, or about 5% to 10% of the maximum width 482 of the consumer product 350, or about 8% of the maximum width 482 of the consumer product 350. In at least one example embodiment, the width 475 of each one of the undercuts 410 is less than 10% of the maximum width 482 of the consumer product 350.

In at least one example embodiment, an angle 422 of the undercuts 410 are acute (FIG. 4A). In at least one example embodiment, the angle 422 of the undercuts 410 are about 75 degrees to 90 degrees. In at least one example embodiment, the angle 422 of the undercuts are obtuse. In at least one example embodiment, the angle 422 of the undercuts 410 are about 105 degrees to 90 degrees. In at least one example embodiment, the angle 422 of the undercut 410, the thickness 425 of the base 110 (FIG. 4A), the width 470 between the apex 430 of the undercuts 410 relative to the maximum width 482 of the consumer product 350, and the materials of construction of the base 110 each are factors that combine to provide the undercuts 410 with a spring force that allows one or both of the undercuts 410 to be flattened as the consumer product 350 is pressed out of the insert 100 (FIG. 4B). In at least one example embodiment, the spring force of the undercuts 410 are able to spring back to a resting position (FIG. 4A) to assist in ejecting the consumer product 350 from the insert 100. In at least one example embodiment, the angle 422 of the undercuts 410 is about 85 degrees, the thickness 425 of the base 110 is about 0.5 mm, the width 470 between the apex 430 of the undercuts 410 is at least 90% of the maximum width 482 of the consumer product 350, and the base 110 is made from polyethylene terephthalate (PET). In at least one example embodiment, the width 475 of each of the undercuts 410 is less than 10% of the maximum width 482 of the consumer product 350, or less than 5% of the maximum width 482 of the consumer product 350. In at least one example embodiment, the width 475 of each of the undercuts 410 is 5% of the maximum width 482 of the consumer product 350.

In at least one example embodiment, the upper end 490 of the consumer product 350 is not in direct contact with the sidewalls 315 or the undercut 410. This can allow the consumer product 350 to more easily be gripped as the consumer product 350 is pressed through the lid (FIG. 4B) and extracted from the insert 100. In at least one example embodiment, only the undercuts 410, and not other major surfaces of the sidewalls 315, are in direct contact with the upper elevation 479 of the consumer product 350. In at least one example embodiment, the major surfaces of the sidewalls 315 are spaced apart from a side of the consumer product 350 (see gap 486 in FIG. 4A). In at least one example embodiment, the gap 486 can further assist in allowing the consumer product 350 to be gripped as the consumer product 350 is pressed through the lid (FIG. 4B) and extracted from the insert 100. In at least one example embodiment, the gap 486 between major surfaces of the sidewalls 315, in conjunction with the combined gap 495 between the ends of the consumer product 350 and the end-walls 450 of the depression 310, assist in allowing the consumer product 350 to be extracted from the insert 100.

In at least one example embodiment, the height 485 of the consumer product 350 is about 6.0 mm, a depth 480 of the depression 310 is about 6.5 mm and a thickness (height) of the upper end 490 of the consumer product 350 (e.g., a portion of the consumer product 350 that extends above the apex 430 of the undercuts 410) is about 0.9 mm. In at least one example embodiment, the height of the upper end 490 of the consumer product constitutes 15% of the height 485 of the consumer product 350. In at least one example embodiment, the remainder of the consumer product 350, other than the upper end 490, is in direct contact and cradled by a combination of the floor 320, the sidewalls 315 and portions of the undercut 410, where the upper end 490 of the consumer product 350 is not in direct contact with the sidewalls 315 and/or portions of the undercut 410. In at least one example embodiment, the height of the upper end 490 constitutes about 20% to 10% of the height 485 of the consumer product 350. In at least one example embodiment, the upper end 490 of the consumer product 350 is left free from direct contact with the sidewalls 315 and/or surfaces of the undercut 410, to assist in allowing the consumer product 350 to be extracted from the depression 310.

Figure 5A:
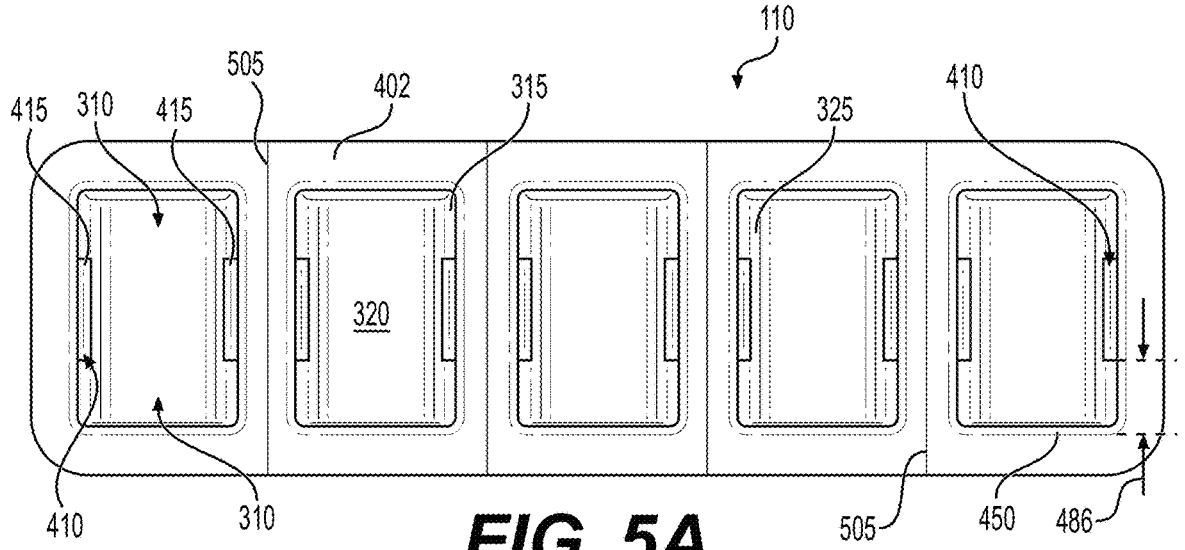
FIG. 5A is an illustration of an overhead view of a base of an insert, in accordance with at least one example embodiment.
Figure 5B:
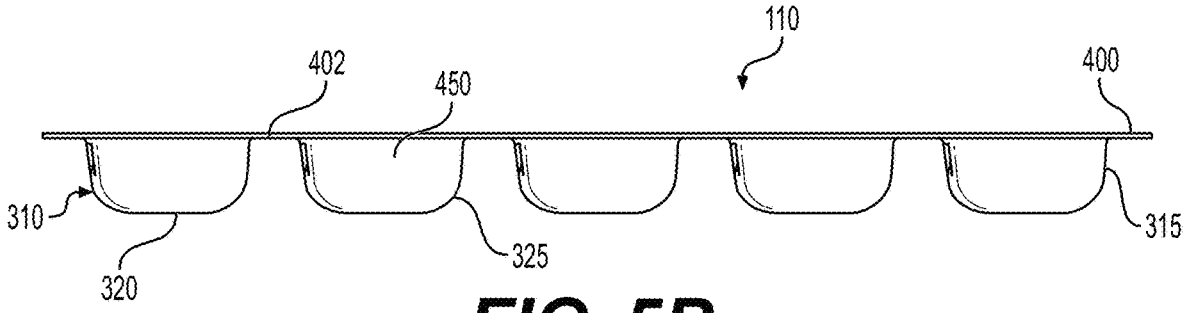
FIG. 5B is an illustration of a side view of a base of an insert, in accordance with at least one example embodiment.
Figure 5C:
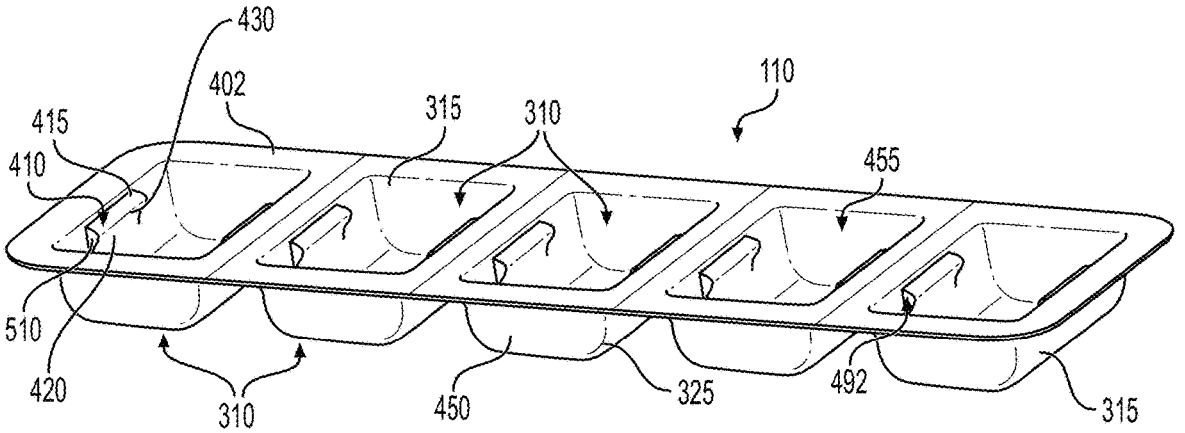
FIG. 5C is an illustration of a perspective view of a base of an insert, in accordance with at least one example embodiment.
Figure 5D:
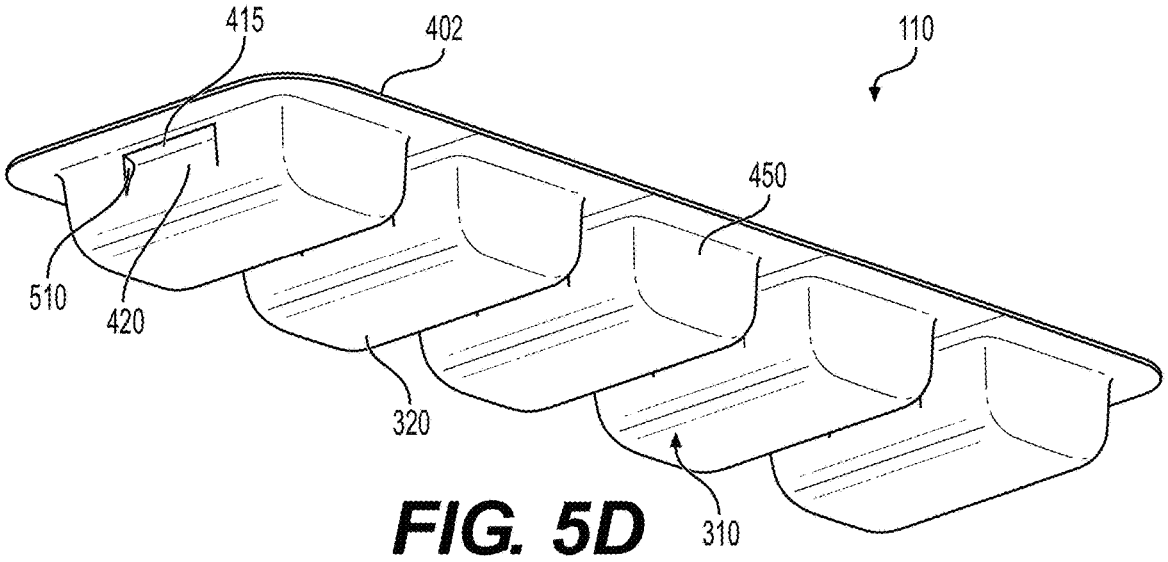
FIG. 5D is an illustration of another perspective view of a base of an insert, in accordance with at least one example embodiment.
Figure 5E:
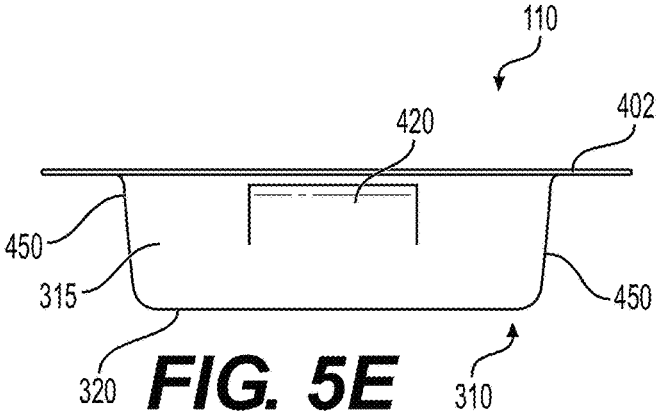
FIG. 5E is an illustration of a front view of a base of an insert, in accordance with at least one example embodiment.

FIG. 5A is an illustration of an overhead view of the base 110 of the insert 100, in accordance with at least one example embodiment. FIGS. 5B-5F are respective side, perspective, front and overhead views of the base 110, in accordance with at least one example embodiment.

In at least one example embodiment, the base 110 defines five of the depressions 310, and each one of the depressions 310 is capable of holding one consume product 350. In at least one example embodiment, the base 110 includes a single one of the depressions 310, or more than one depression 310.

In at least one example embodiment, the end-walls 450 of each of the depressions 310 is flared outward, from the floor 320 to the upper brim 402 of the insert 100. Therefore, in at least one example embodiment, the end-walls 450 that are opposing each other for each of the depressions 310 are closest together at the floor 320, and the end-walls 450 are furthest apart from each other at the upper brim 402. In at least one example embodiment, this allows for the consumer products 350 to be more easily extracted from the depressions 310 during a use of the insert 100, as the end-walls 450 are spaced further apart from the consumer product 350 near an upper portion of the depression 310. In at least one example embodiment, an "opened-top" nature of the base 110 (with open access to the depressions from a top of the base 110), in conjunction with the end-walls 450 and the sidewalls 315 being flared in an outward direction, assist in increasing a loading speed of the base 110 with the consumer product 350 during manufacturing processes.

Figure 5F:
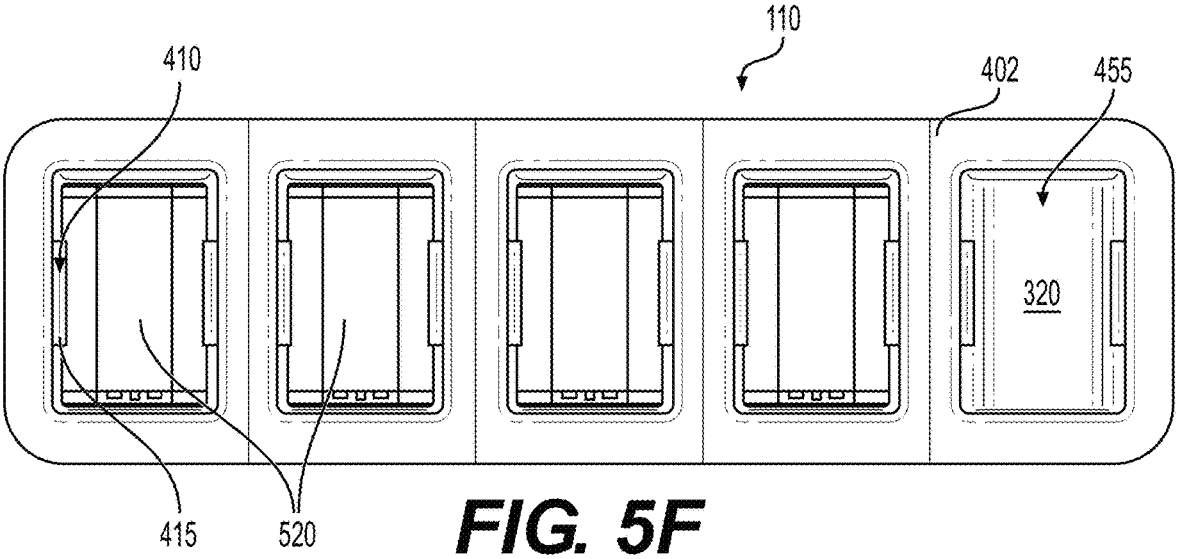
FIG. 5F is an overhead view of a base of an insert, with spent consumer products in the base, in accordance with at least one example embodiment.

In at least one example embodiment, as the consumer products 350 are removed from the insert 100 (see FIG. 4B) and consumed, a resultant spent consumer product 520 can be retained within the cavity 455 of the depression 310 (FIG. 5F). In at least one example embodiment, the retention of the spent consumer product 520 can ensure proper dispose of the insert 100 and the spent consumer product 520. In at least one example embodiment, the base 110, the lid 120 and/or the consumer product 350 is made from a recyclable material or materials.

In at least one example embodiment, a divider line 505 is defined across a width of the base 110 at locations that are between the depressions 310. In at least one example embodiment, the divider lines 505 are formed during a manufacturing process. In at least one example embodiment, the divider lines 505 are defined in locations directly below the divider lines 160 of the lid 120. In at least one example embodiment, the divider lines 505 and 160 are perforated, scored or embossed lines that forms lines of weakness that may allow individual sections of the insert 100 to be removed from a remainder of the insert 100.

In at least one example embodiment, the base 110 is opaque. In at least another example embodiment, the base 110 is transparent (see FIG. 7), or translucent.

In at least one example embodiment, the end-surface 492 of the undercuts 410 define a wedge 510 that is triangular in shape.

Figure 6A:
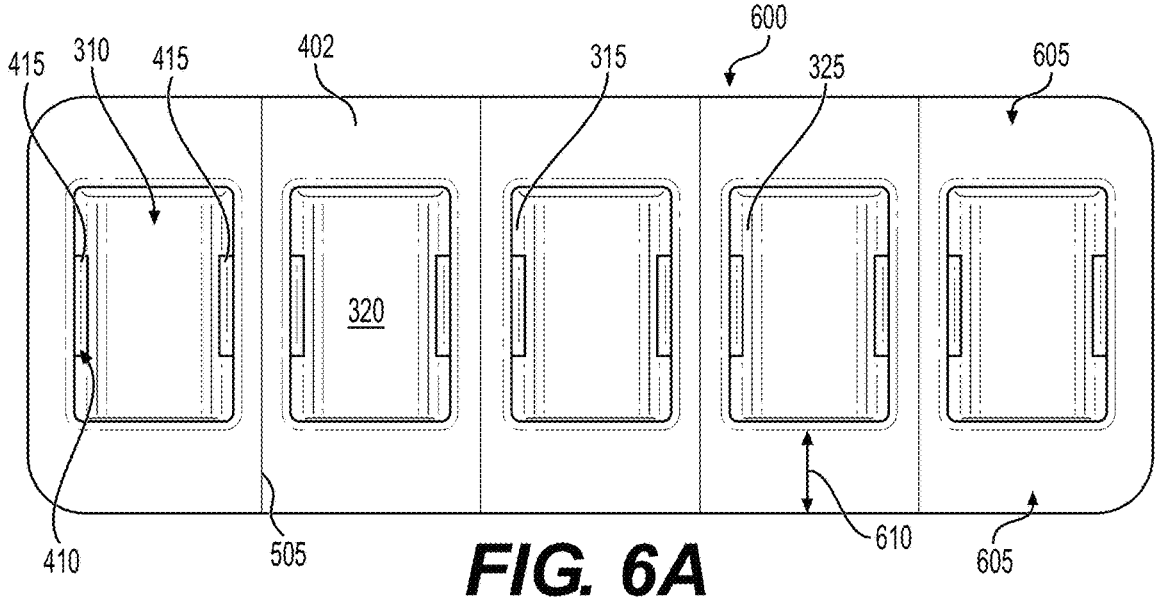
FIG. 6A is an illustration of an overhead view of a base of an insert, in accordance with at least one example embodiment.
Figure 6B:
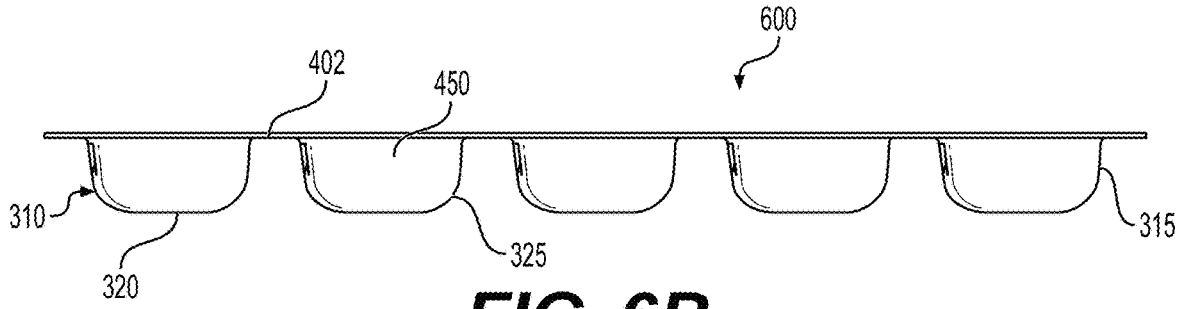
FIG. 6B is an illustration of a side view of a base of an insert, in accordance with at least one example embodiment.
Figure 6C:
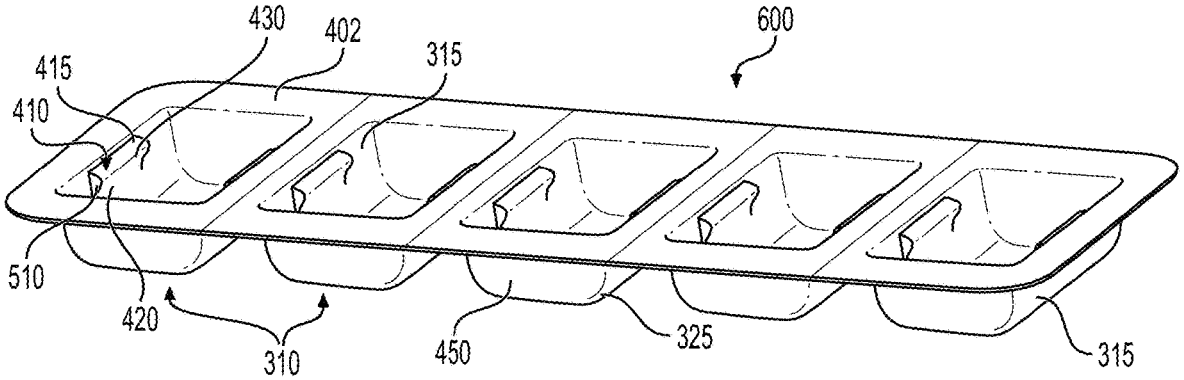
FIG. 6C is an illustration of a perspective view of a base of an insert, in accordance with at least one example embodiment.
Figure 6D:
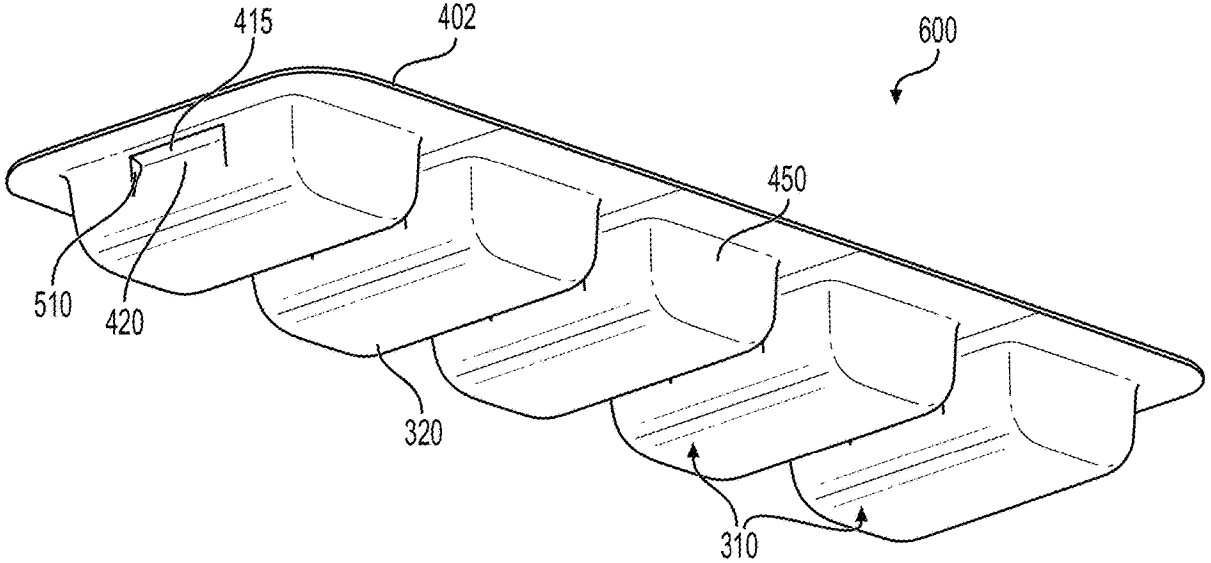
FIG. 6D is an illustration of another perspective view of a base of an insert, in accordance with at least one example embodiment.
Figure 6E:
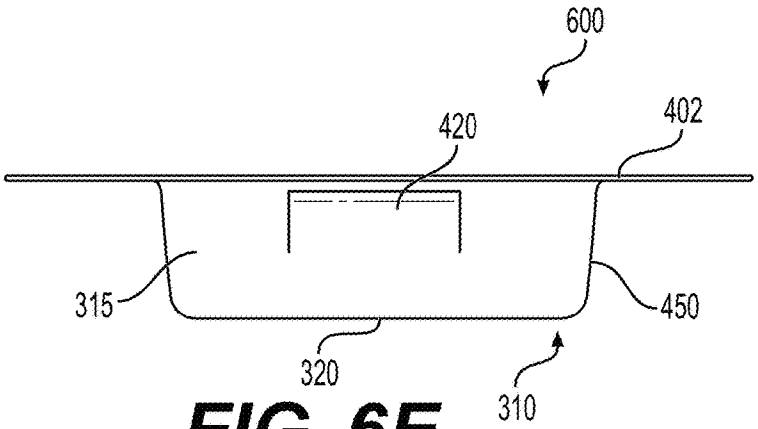
FIG. 6E is an illustration of a front view of a base of an insert, in accordance with at least one example embodiment.

FIG. 6A is an illustration of an overhead view of a base 600 of the insert 100, in accordance with at least one example embodiment. FIGS. 6B-E are respective illustrations of side, perspective and front views of the base 600, in accordance with at least one example embodiment.

In at least one example embodiment, a width 610 of a brim 605 of the base 600 is larger (see FIG. 6A), relative to the base 110 (see FIG. 5A).

Figure 7:
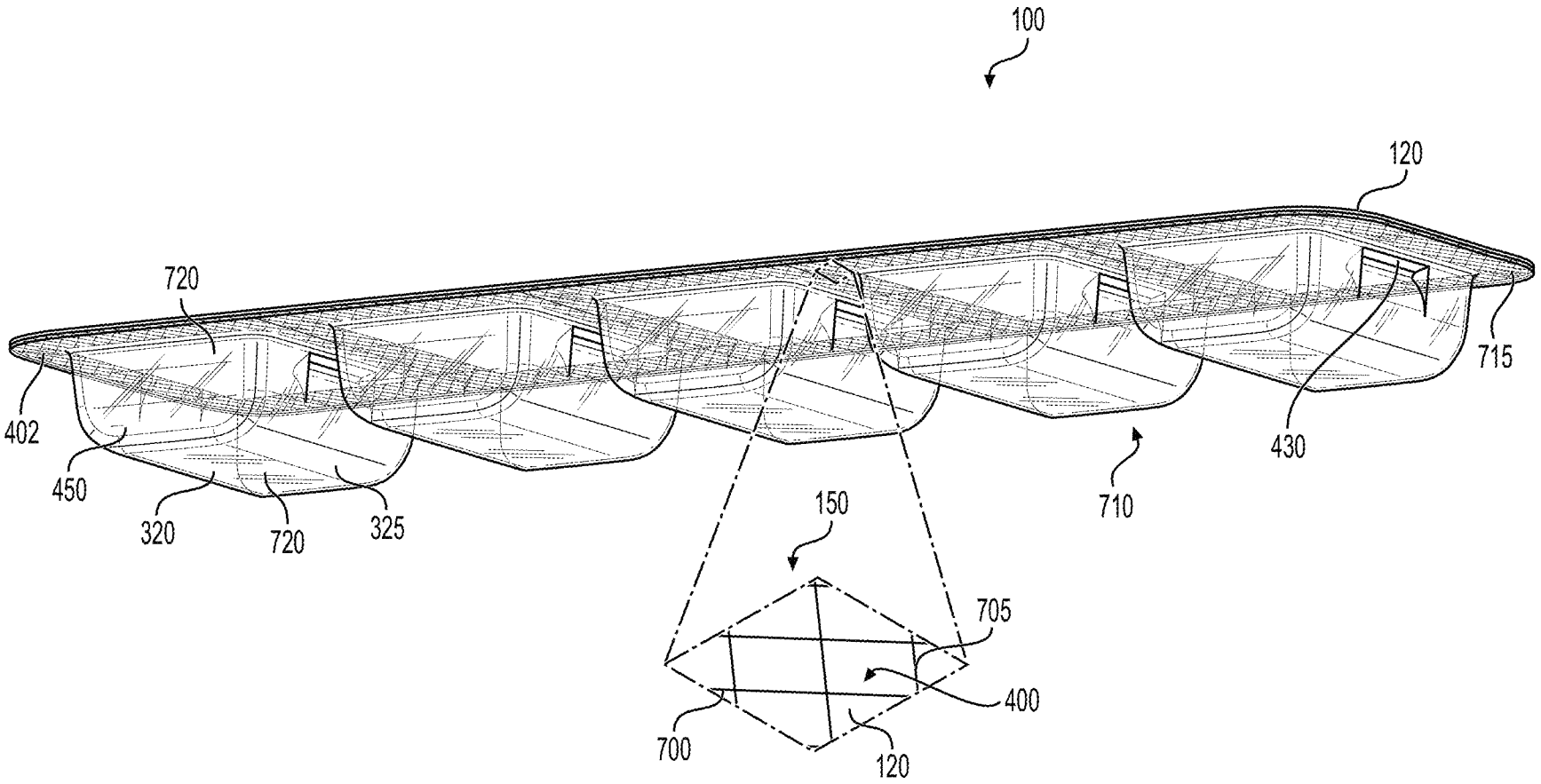
FIG. 7 is an illustration of a lower perspective view of an insert, in accordance with at least one example embodiment.

FIG. 7 is an illustration of a lower perspective view of the insert 100, in accordance with at least one example embodiment.

In at least one example embodiment, the base 710 of the insert 100 is transparent, or translucent. In at least one example embodiment, the upper surface 400 of the upper brim 402 is corrugated and/or an "egg crate" structure, with grooves (voids) 700 along the upper surface 400. In at least one example embodiment, an adhesive 705 connects the lid 120 to the base 710. In at least one example embodiment, the adhesive 705 can, for instance, fill the grooves 700 to allow the lid 120 to be more firmly secured to the upper surface 400 of the upper brim 402 of the base 710 (see at least FIGS. 4A and 7). In at least one example embodiment, a lower surface of the lid 120 can be corrugated and/or an "egg crate" structure, with grooves 715 that allow the adhesive 705 to fill the grooves 715, at least for the portions of the lid 120 that connect to the upper surface 400 of the upper brim 402. In at least one example embodiment, the adhesive 705 is an epoxy, a hot melt, a water-based or solvent-based adhesive or polymer, other suitable adhesive materials, or combinations thereof. In at least one example embodiment, the adhesive 705 is made from a recyclable material. In at least one example embodiment, the base 710 is identical to the base 110 (FIG. 5A), aside from the base 710 being transparent.

In at least one example embodiment, the lid 120 is made from the same material as the base 110 and/or the base 710. In at least one example embodiment, the lid 120 is transparent.

In at least one example embodiment, the base 710, the lid 120, or both the base 710 and the lid 120 include a one-way molecular device 720. In at least one example embodiment, the one-way molecular device 720 is a one-way valve, an oxygen sieve, a molecular sieve, or combinations thereof, that allow for a transmission of Oxygen and/or air from an interior of the depression 310 into ambient air outside of the insert 100 (e.g., allow for a transmission of Oxygen and/or air in a single direction).

Figure 8A:
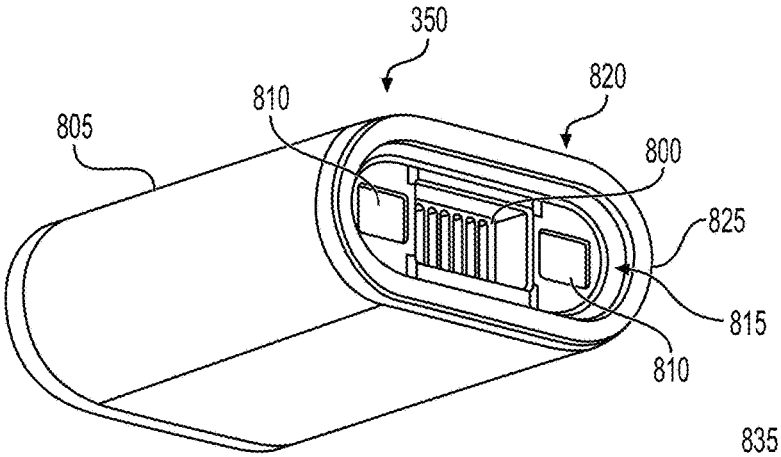
FIG. 8A is an illustration of a perspective view of a cartridge, in accordance with at least one example embodiment.
Figure 8B:
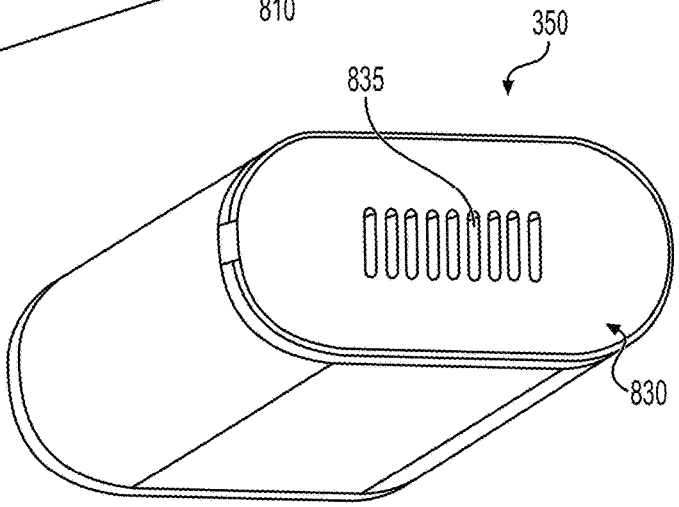
FIG. 8B is an illustration of another perspective view of a cartridge, in accordance with at least one example embodiment.
Figure 8C:
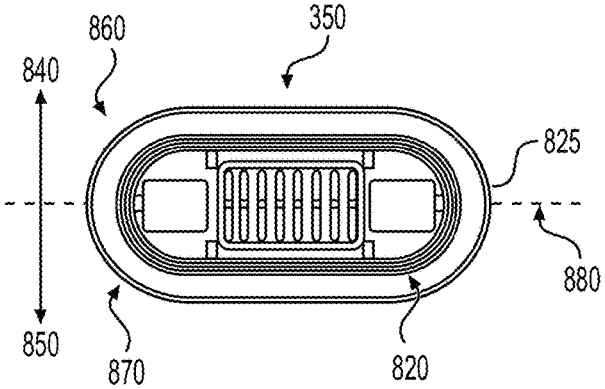
FIG. 8C is an illustration of a side view of a cartridge, in accordance with at least one example embodiment.
Figure 8D:
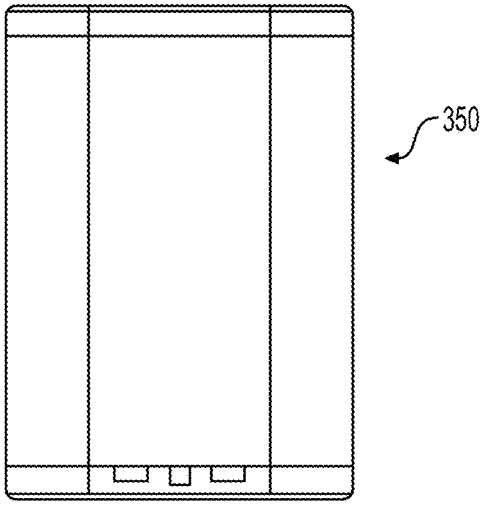
FIG. 8D is an illustration of an overhead view of a cartridge, in accordance with at least one example embodiment.

FIG. 8A is an illustration of a perspective view of a consumer product 350, in accordance with at least one example embodiment. FIGS. 8B-8D are illustrations of respective other perspective, side, and overhead views of the consumer product 350, in accordance with at least one example embodiment.

In at least one example embodiment, the consumer product 350 is a cartridge. In at least one example embodiment, the consumer product 350 has a rectangular horizontal cross-section, or footprint (see the overhead view in FIG. 8D). In at least one example embodiment, the consumer product 350 has a housing 805 that is in the shape of a flattened block with rounded sidewalls 825 and a somewhat rectangular shaped vertical cross-section. In at least one example embodiment, the rounded sidewalls 825 are opposing convex outer sidewalls on either side of the consumer product 350. In at least one example embodiment, the consumer product 350 has a first end 820 with electrical contacts 810. In at least one example embodiment, the first end 820 defines a first vent 800. In at least one example embodiment, the consumer product 350 has a second end 830. In at least one example embodiment, the second end 830 defines a second vent 835. In at least one example embodiment, the first end 820 and the second end 830 of the consumer product 350 are flat or substantially flat, aside from the first end 820 having a somewhat recessed area 815.

Referring to FIGS. 8C and 4A, in at least one example embodiment the lower inclined segment 420 of each of the undercuts 410 of the base 110 of the insert 100 are conformed to a shape of at least a part an upper portion 860 of each of the rounded sidewalls 825 of the consumer product 350 (the upper portion 860 being on the upper end 840 of the consumer product 350, as shown in FIG. 8C). In at least one example embodiment, the sidewalls 315 of the depression 310 of the base 110 are conformed to a shape of at least a part a lower portion 870 of the rounded sidewall 825 of the consumer product 350 (the lower portion 870 being on the lower end 850 of the consumer product 350, as shown in FIG. 8C). In at least one example embodiment, the upper portion 860 and the lower portion 870 of the rounded sidewalls 825 of the consumer product 350 have a vertical cross-section that are arcuate-shaped (see FIG. 8C). In at least one example embodiment, the concave interior surfaces 414 of each of the depressions 310 is conformed to the rounded sidewalls 825 of the consumer product 350, or at least conformed to a portion of the rounded sidewalls 825 that is below the upper end 490 of the consumer product 350 (see FIG. 4A).

Referring to FIGS. 8C and 4C, in at least one example embodiment, the maximum width 482 of the consumer product 350 exists at an elevation corresponding to a plane 880 that runs through a mid-section of the consumer product 350. In at least one example embodiment, the plane 880 divides the consumer product 350 into equal halves, where the upper end 840 and the lower end 850 of the consumer product 350 each constitute a respective upper half and a lower half of the consumer product 350.

Figure 9:
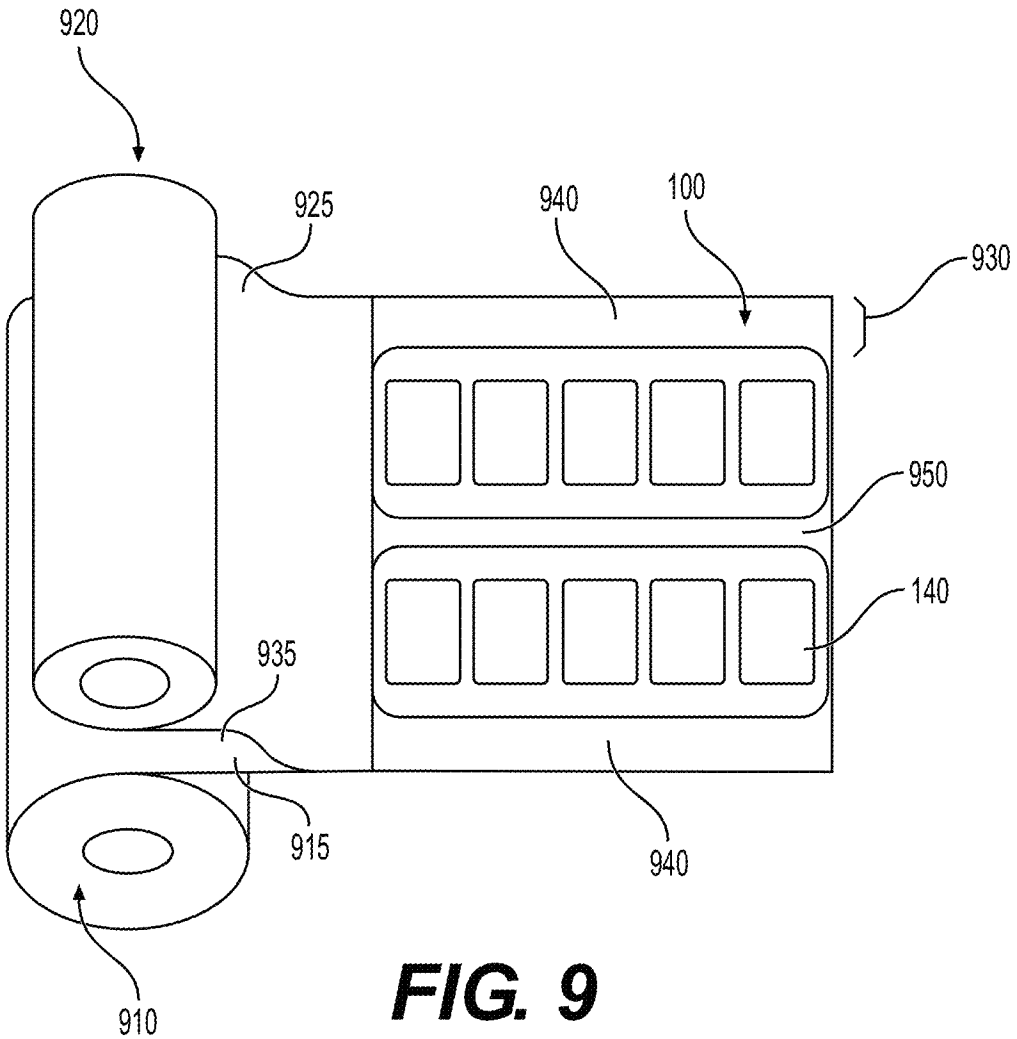
FIG. 9 is an illustration of a process step of making an insert, in accordance with at least one example embodiment.

FIG. 9 is an illustration of a process step of making the insert 100, in accordance with at least one example embodiment.

In at least one example embodiment, a first spool 910 holding a first sheet of material 915 and a second spool 920 containing a second sheet of material 925 are unwound. In at least one example embodiment, the first sheet of material 915 is used to make the base 110 and the second sheet of material 925 is used to make the lid 120. In at least one example embodiment, the first sheet of material 915 and the second sheet of material 925 are processed prior to being joined to form the insert 100, or the first sheet of material 915 and the second sheet of material 925 are processed after or while they are joined to form the insert 100. In at least one example embodiment, the processing of the first sheet of material 915 and the second sheet of material 925 include stamping, embossing, molding the materials, which may include an application of heating and melting, in order to form the depressions 310 and/or the weakened areas 140. In at least one example embodiment, the weakened areas 140 are pre-processed prior to the second sheet of material 925 being wound around the second spool 920. In at least one example embodiment, either before, during or after the first sheet of material 915 and the second sheet of material 925 are joined, a center section 950 and side portions 940 of the first sheet of material 915 and the second sheet of material 925 are trimmed to remove excess material. In at least one example embodiment, the first sheet of material 915 and the second sheet of material 925 are heated and molded as a part of a thermoplastic formation and processing of the base 110 and the lid 120. Other means of manufacturing the base 110, the lid 120 and the insert 100 are contemplated.

In at least one example embodiment, one or more surfaces of the first sheet of material 915 and the second sheet of material 925 include an oxygen scavenger 935, or a layer of material that includes the oxygen scavenger 935. In at least one example embodiment, the oxygen scavenger 935 is included on an upper surface of the first layer of material 915 that form interior surfaces of the depressions 310, and/or the oxygen scavenger 935 is included on lower surfaces of the second layer of material 925 that form an interior surface of the lid 120. In at least one example embodiment, the oxygen scavenger 935 is on both an upper and lower surface of the first layer of material 915 and/or the second layer of material 925. In at least one example embodiment, the oxygen scavenger 935 is applied to the first layer of material 915 and the second layer of material 925 following a formation of the base 110 and the lid 120, or the oxygen scavenger 935 is at least applied to interior surfaces of the depressions 310 following a formation of the base 110. In at least one example embodiment, the oxygen scavenger 935 is embedded in a polymer matrix and applied to a portion of the first layer of material 915 and/or the second layer of material 925, and/or the oxygen scavenger 935 is embedded within at least a portion of the first layer of material 915 and/or the second layer of material 925. In at least one example embodiment, the oxygen scavenger 935 includes iron fragments, or other known oxygen scavenger material.

Figure 10:
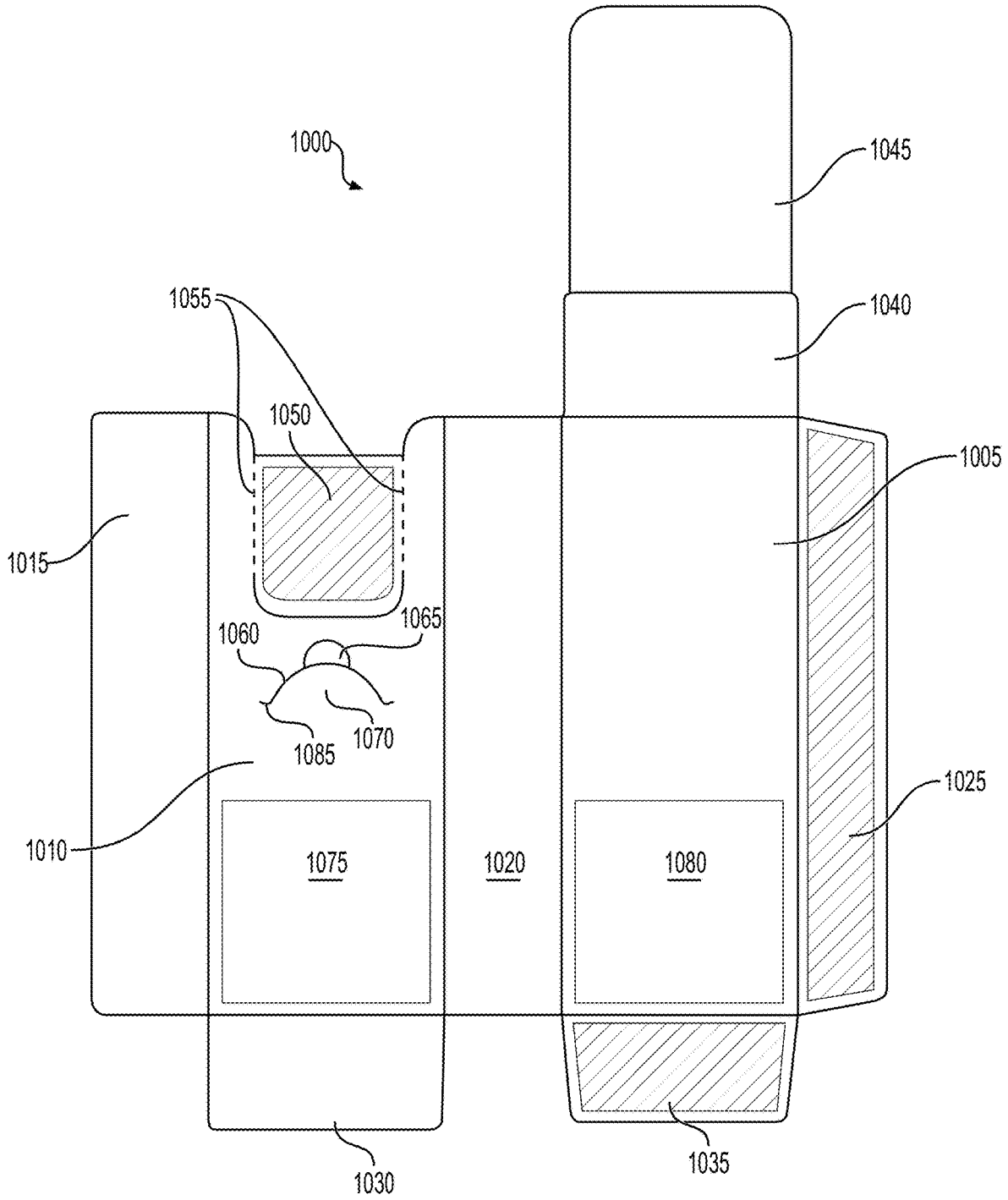
FIG. 10 is an illustration of a blank for an outer box of a package, in accordance with at least one example embodiment.
Figure 11:
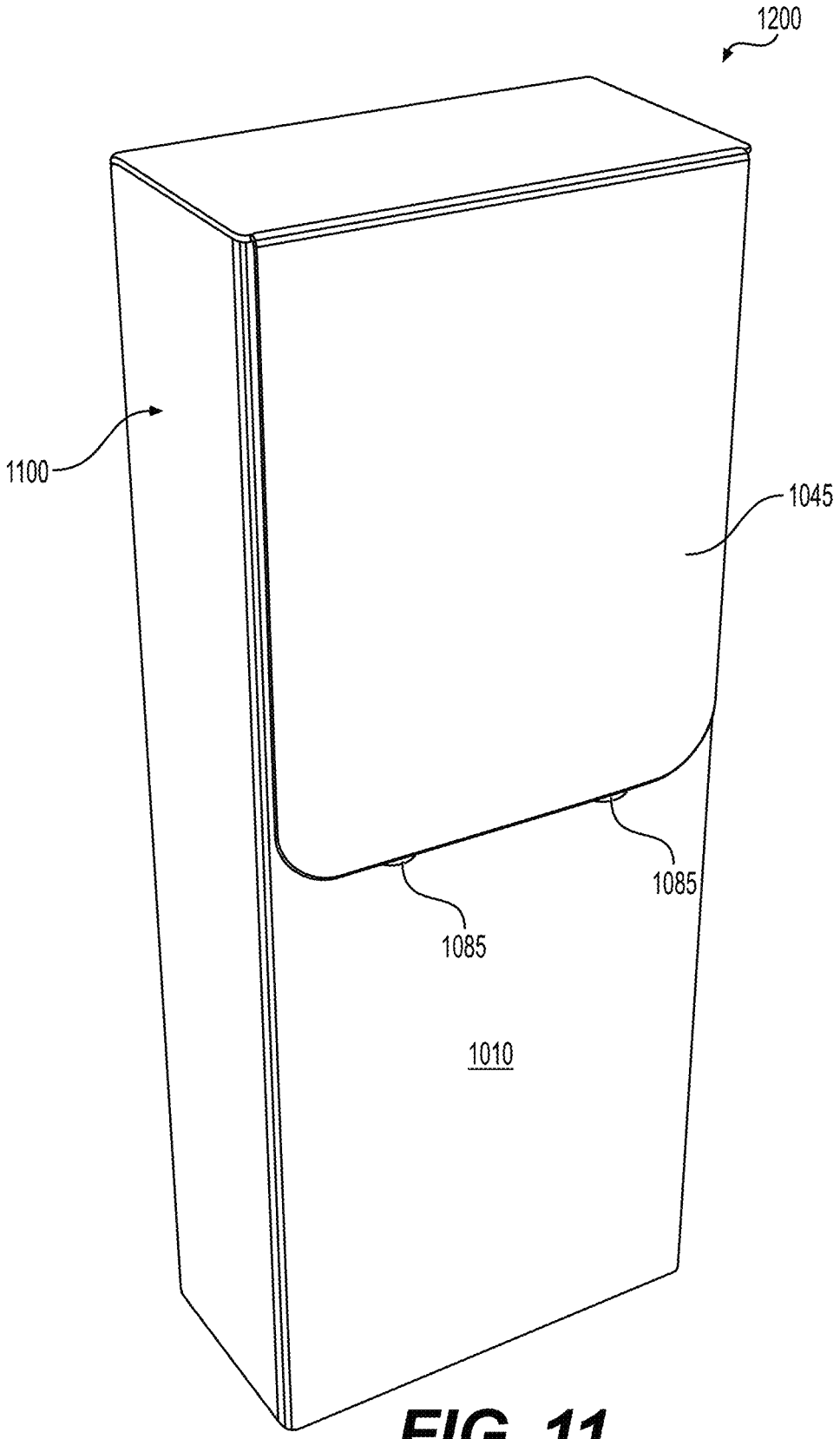
FIG. 11 is an illustration of a package, in accordance with at least one example embodiment.
Figure 12:
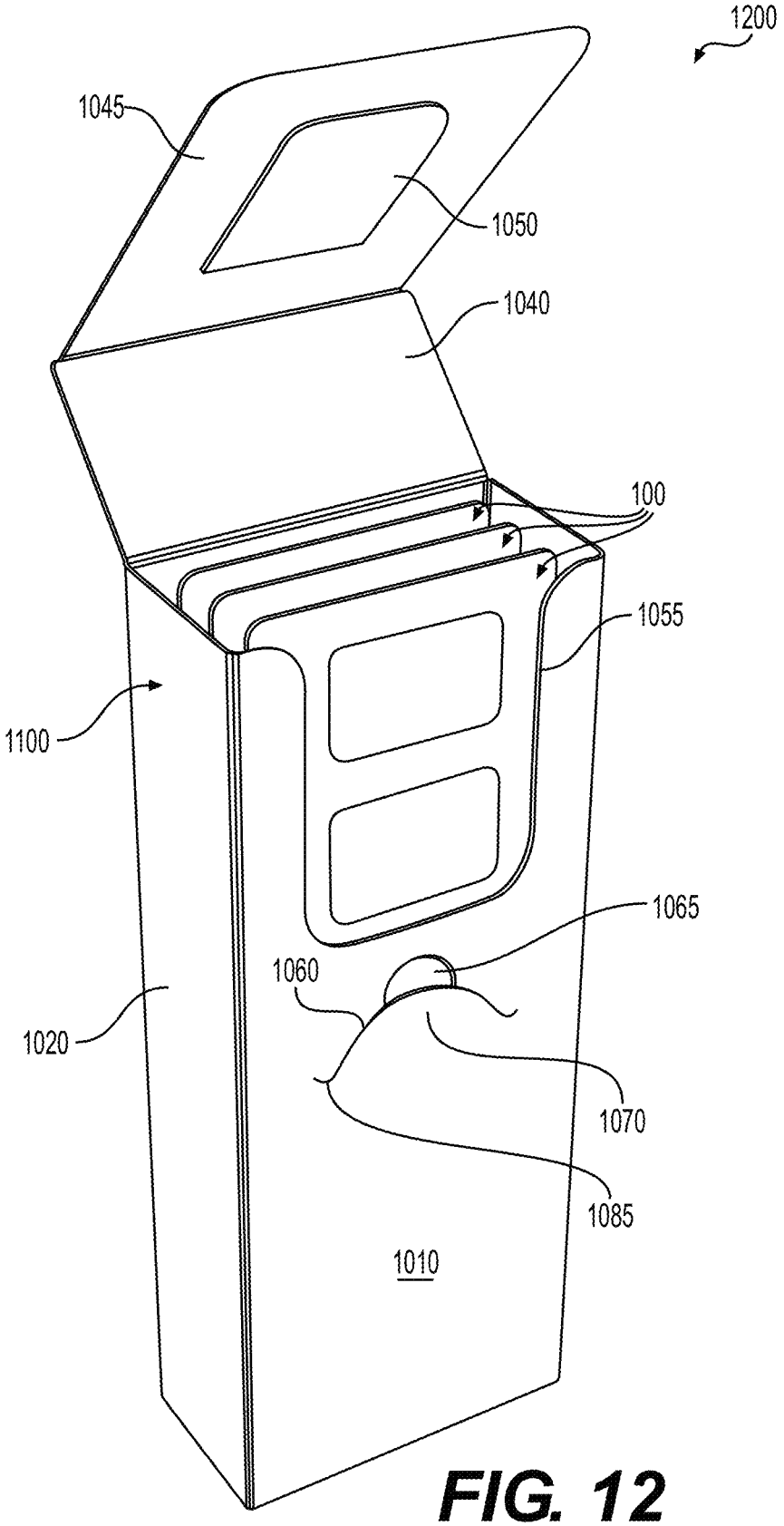
FIG. 12 is an illustration of a package in an opened configuration, in accordance with at least one example embodiment.
Figure 13:
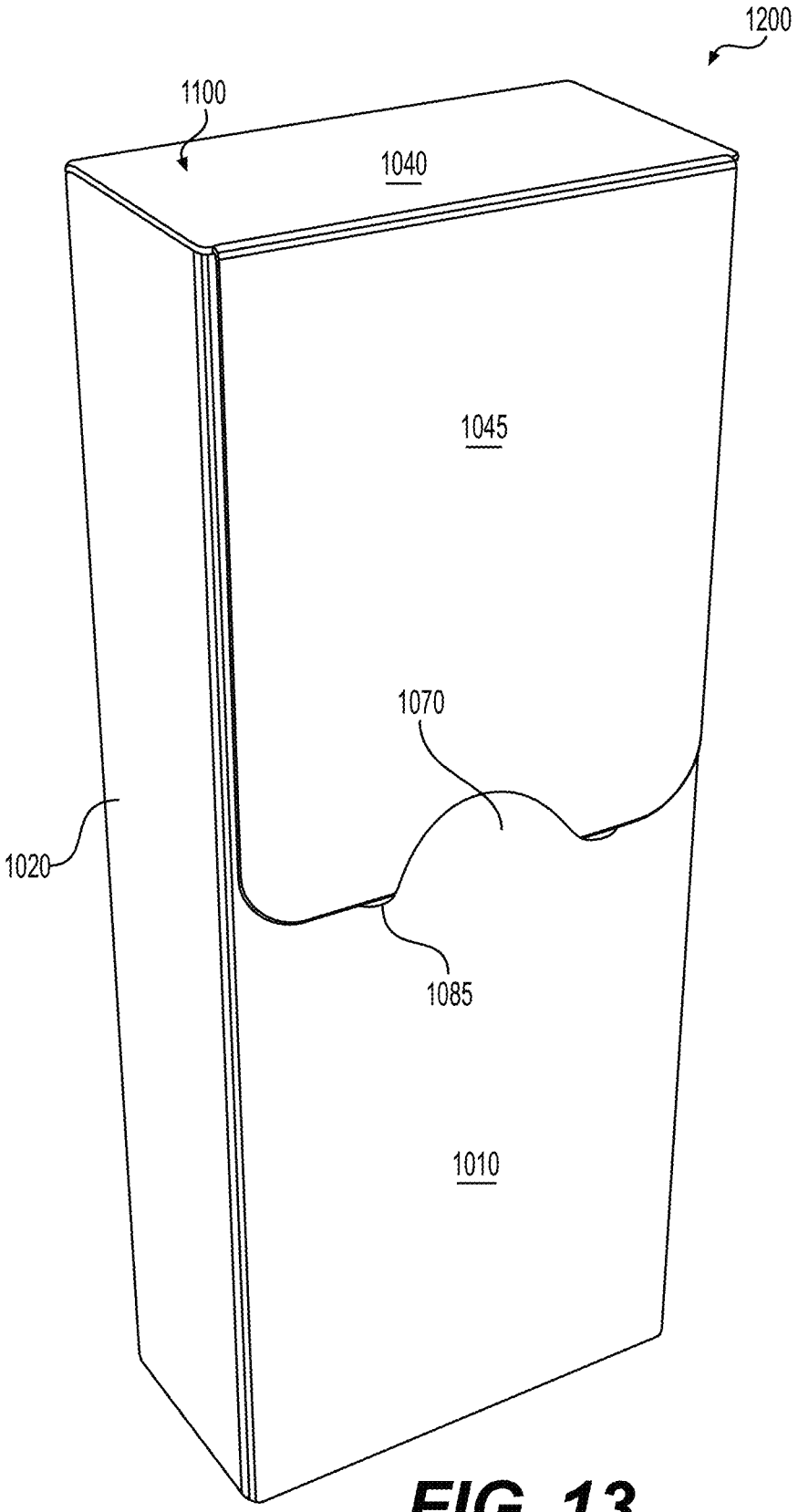
FIG. 13 is an illustration of a package that has been reclosed, in accordance with at least one example embodiment.
Figure 14:
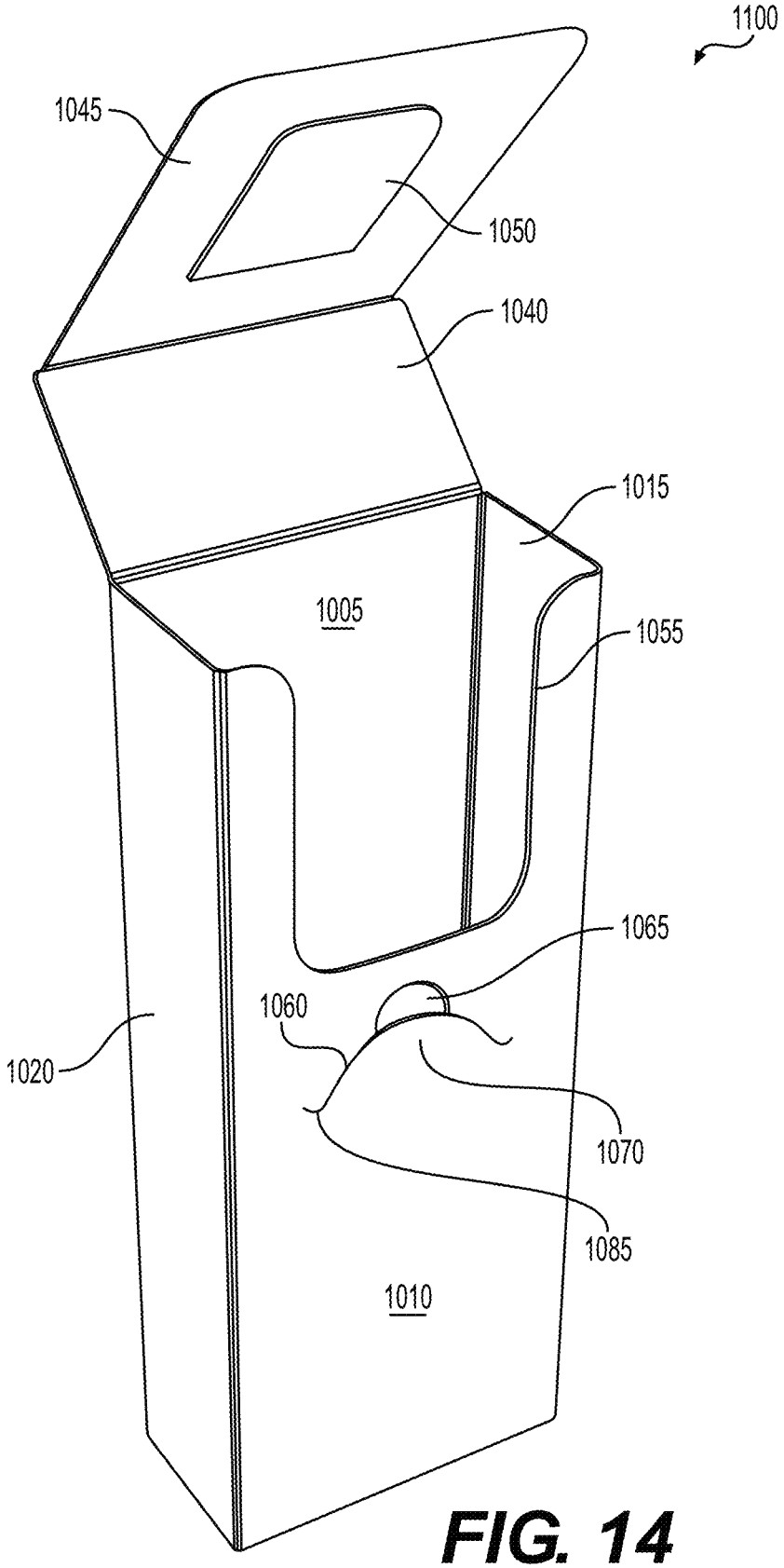
FIG. 14 is an illustration of a perspective view of an outer box in an opened configuration, in accordance with at least one example embodiment.

FIG. 10 is an illustration of a blank 1000 for an outer box 1100 of a package 1200, in accordance with at least one example embodiment. FIG. 11 is an illustration of the package 1200, in accordance with at least one example embodiment. FIG. 12 is an illustration of the package 1200 in an opened configuration, in accordance with at least one example embodiment. FIG. 13 is an illustration of the package 1200 in a reclosed configuration, in accordance with at least one example embodiment. FIG. 14 is an illustration of a perspective view of the outer box 1100 in an opened configuration, in accordance with at least one example embodiment.

In at least one example embodiment, the blank 1000 includes a front panel 1010 with vertical edges that are connected to a first side panel 1015 and a second side panel 1020. In at least one example embodiment, the second side panel 1020 connects the front panel 1010 to a back panel 1005. In at least one example embodiment, lower edges of the front panel 1010 and the back panel 1005 are respectively connected to a first bottom panel 1030 and a second bottom panel 1035. In at least one example embodiment, a vertical edge of the back panel 1005 is connected to a third side panel 1025, and an upper edge of the back panel 1005 is connected to a top panel 1040. In at least one example embodiment, the top panel 1040 includes a first flap panel 1045. In at least one example embodiment, at least a portion of the front panel 1010 and the back panel 1005 include a first varnish free area 1075 and a second varnish free area 1080, respectively.

In at least one example embodiment, the front panel 1010 defines a slit 1060. In at least one example embodiment, the slit 1060 is arcuate shaped. In at least one example embodiment, the front panel 1010 defines rounded edges 1085 on lower ends of the slit 1060. In at least one example embodiment, a second flap panel 1070 is extendible from the front panel 1010 due to the slit 1060 (see FIG. 13). In at least one example embodiment, a first cutout 1065 is defined above the slit 1060. In at least one example embodiment, weakened delineation lines 1055 are defined by the front panel 1010, where the weakened delineation lines 1055 at least partially define a second cutout 1050.

In at least one example embodiment, the blank 1000 is folded to form the outer box 1100 (FIG. 14). In at least one example embodiment, an adhesive is applied to at least the third side panel 1025 and the second bottom panel 1035 to assemble the outer box 1100. In at least one example embodiment, one or more of the inserts 100 are inserted into the outer box 1100 to form the package 1200 (see FIG. 12). In at least one example embodiment, the adhesive is applied to an outer surface of the second cutout 1050 to hold the first flap panel 1045 in a closed position to initially seal the package 1200 (FIG. 11). In at least one example embodiment, upon initially opening the package 1200, the second cutout 1050 is removed (torn) from the front panel 1010, and the second cutout 1050 is retained by the first flap panel 1045 (FIG. 12). In at least one example embodiment, the retention of the second cutout 1050 on the first flap panel 1045, upon an initial opening of the package 1200, provides proof of tampering of the outer box 1100. In at least one example embodiment, once the package 1200 is initially opened, the outer box 1100 may be reclosed by extending the second flap panel 1070 from the front panel 1010 and retaining the first flap panel 1045 with the second flap panel 1070 (FIG. 13). In at least one example embodiment, the outer box 1100 is therefore re-closeable, allowing for the removal of consumer products 350 from a respective one of the inserts 100, and a reclosing of the outer box 1100 between uses of the consumer products 350. In at least one example embodiment, the spent consumer products 520 may be returned and retained within a respective one of the depressions 310 within the outer box 1100. In at least one example embodiment, the outer box 1100 can retain inserts 100 containing the spent consumer products 520 for a proper disposal of the outer box 1100, the inserts 100 and the spent consumer products 520. In at least one example embodiment, an overwrapping of the outer box 1100 is unnecessary, as the insert 100 keeps the consumer product 350 fresh, and the insert 100 acts as a dust barrier for the consumer product 350.

Figure 15:
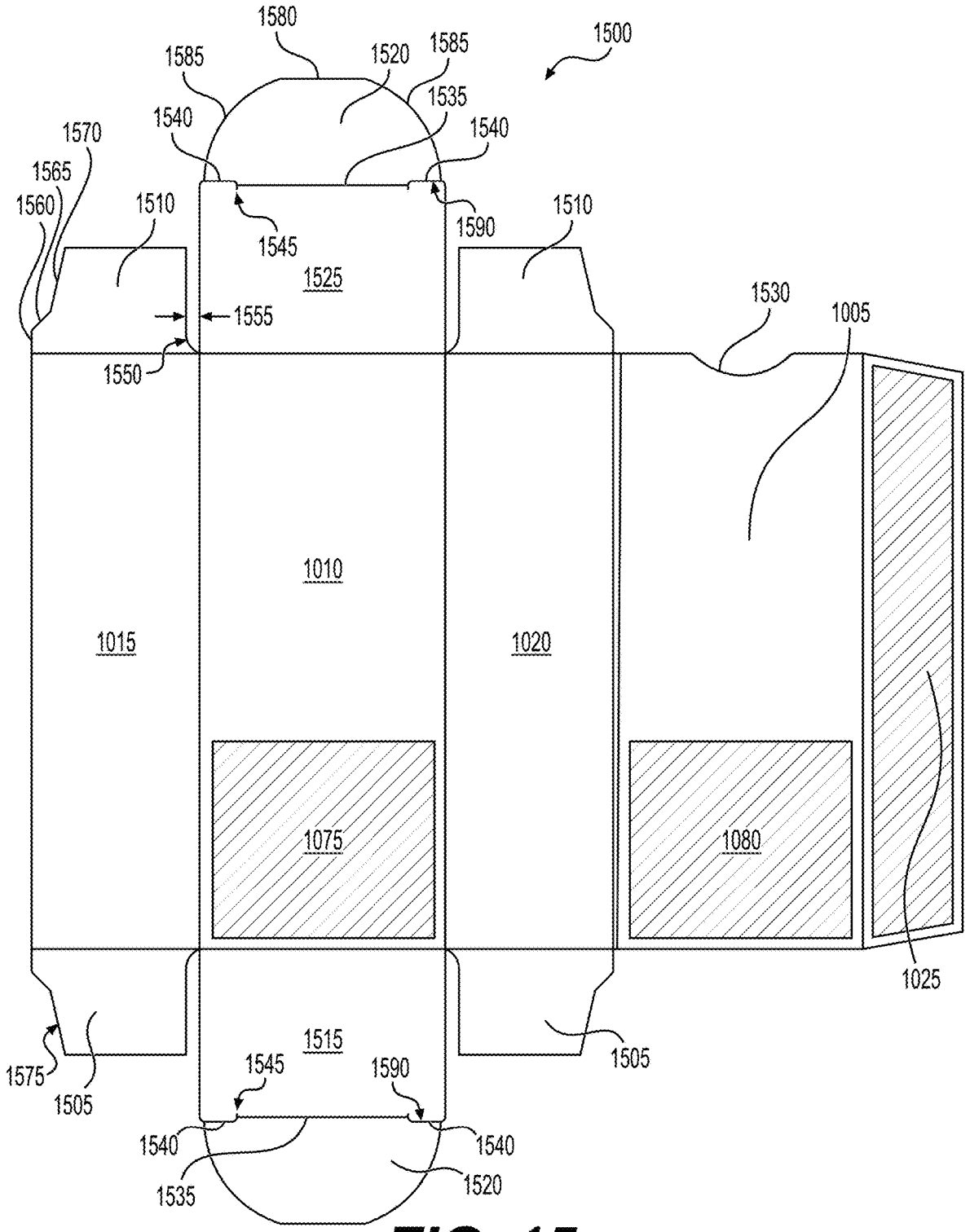
FIG. 15 is an illustration of a blank for an outer box of a package, in accordance with at least one example embodiment.
Figure 16:
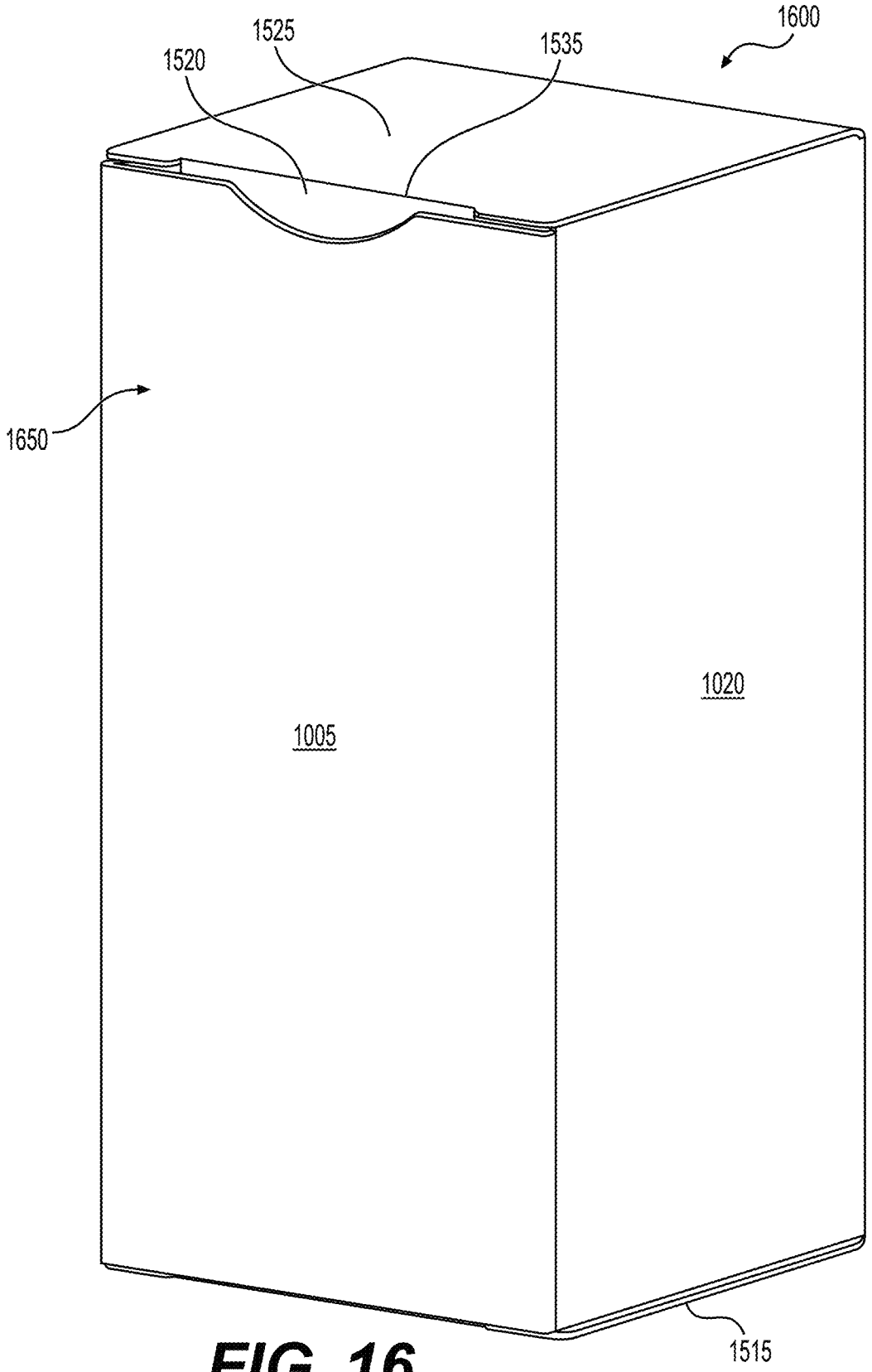
FIG. 16 is an illustration of a package, in accordance with at least one example embodiment.
Figure 17:
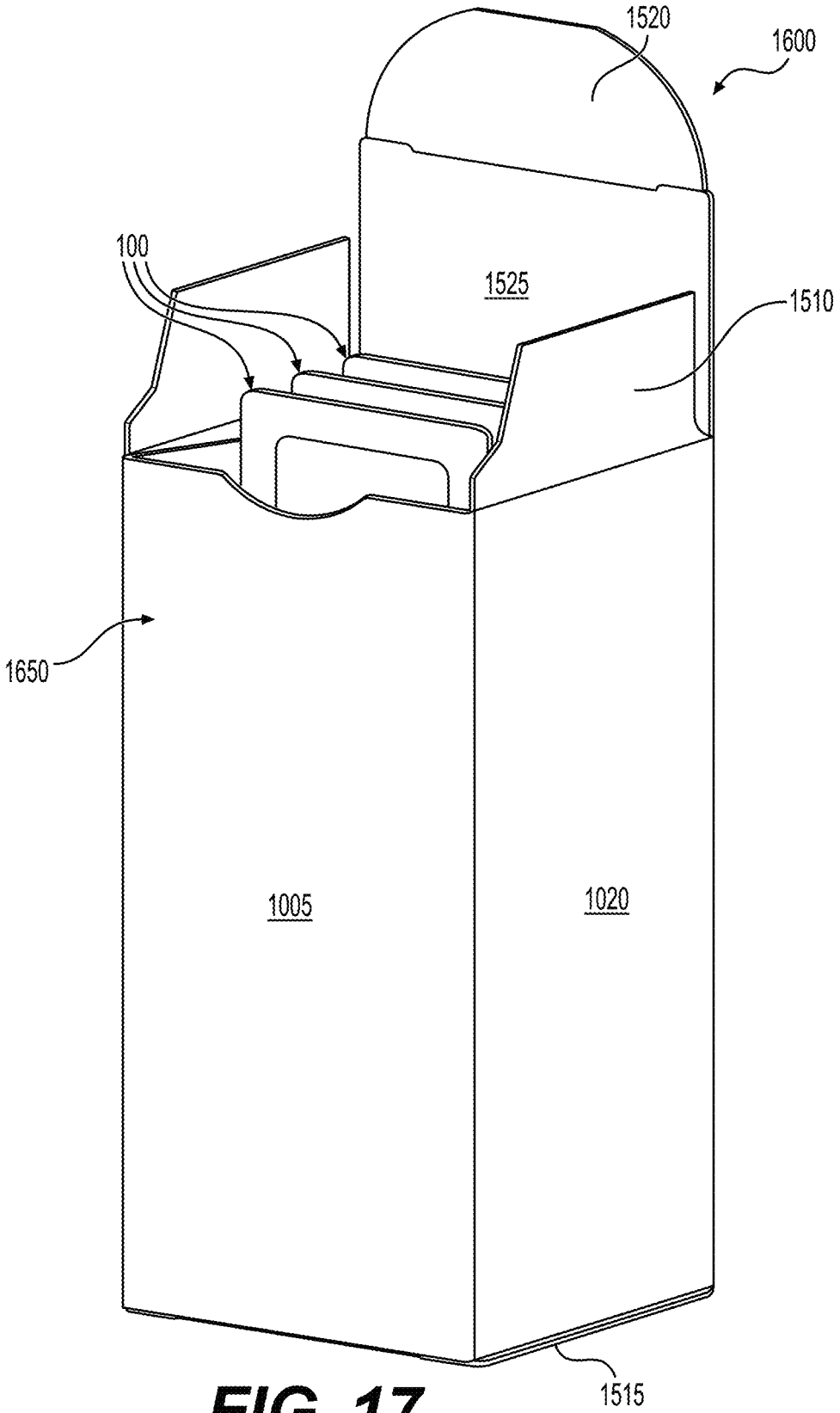
FIG. 17 is an illustration of a package in an opened configuration, in accordance with at least one example embodiment.

FIG. 15 is an illustration of a blank 1500 for an outer box 1650 of a package 1600, in accordance with at least one example embodiment. FIG. 16 is an illustration of the package 1600, in accordance with at least one example embodiment. FIG. 17 is an illustration of the package 1600 in an opened configuration, in accordance with at least one example embodiment.

In at least one example embodiment, the blank 1500 and the outer box 1650 are the same as the blank 1000 and the outer box 1100, with the following differences. In at least one example embodiment, and as shown in FIG. 15, the blank 1500 includes a top panel 1525 and a bottom panel 1515 connected to an upper edge and a lower edge of the front panel 1010, respectively. In at least one example embodiment, the top panel 1525 and the bottom panel 1515 are a same size. In at least one example embodiment, the top panel 1525 and the bottom panel 1515 each have a tuck panel 1520 on a respective distal end of the top panel 1525 and the bottom panel 1515, where a first fold line 1535 divides the top panel 1525 and the bottom panel 1515 from the tuck panel 1520. In at least one example embodiment, a pair of side slits 1540 are respectively defined by the top panel 1525, the bottom panel 1515 and the tuck panels 1520. In at least one example embodiment, a major portion 1590 of each of the pair of side slits 1540 runs parallel with the first fold line 1535. In at least one example embodiment, each of the pair of side slits 1540 includes a curved portion 1545 that terminates within the top panel 1525 and the bottom panel 1515, respectively. In at least one example embodiment, each of the tuck panels 1520 includes a straight end edge 1580 on a distal end of the tuck panel 1520. In at least one example embodiment, the straight end edge 1580 of each of the tuck panels 1520 is between a pair of arcuate shaped side edges 1585. In at least one example embodiment, each of the tuck panels 1520 is identical to each other in size and shape.

In at least one example embodiment, the blank 1500 includes a pair of upper dust panels 1510 and a pair of lower dust panel 1505. In at least one example embodiment, the pair of upper dust panels 1510 and the pair of lower dust panel 1505 are identical to each other in size and shape. In at least one example embodiment, each of the dust panels 1505/1510 includes an arcuate shaped side surface 1550 that offsets the dust panels 1505/1510 from the top panel 1525 and the lower panel 1515, respectively, such that a gap 1555 exists between a majority of a side edge of the dust panels 1505/1510 and the top panel 1525 and bottom panel 1515. In at least one example embodiment, the gap 1555 allows the outer box 1650 (FIG. 16) to be more easily assembled from the blank 1500, and the gap 1555 removes strain and undesired tearing and waste of the material of the blank 1500, both during an assembly and during a use of the outer box 1650. In at least one example embodiment, each of the dust panels 1505/1510 defines a cut-out 1575 on an outer side edge of the dust panels 1505/1510. In at least one example embodiment, the cut-out 1575 is defined by a first diagonal side edge 1565 that extends between a vertical side edge 1560 and a second diagonal side edge 1570. In at least one example embodiment, the first diagonal side edge 1565 has a steeper incline angle than the second diagonal side edge 1570, relative to the vertical side edge 1560.

In at least one example embodiment, a top edge of the back panel 1005 defines a cut-out 1530. In at least one example embodiment, the cut-out 1530 is arcuate-shaped or crescent shaped. In at least one example embodiment, the cut-out 1530 allows the tuck panel 1520 of the top panel 1525 to be more easily accessed to assist in opening a top portion of the outer box 1650, once the outer box 1650 is assembled (see FIG. 16).

In at least one example embodiment, the blank 1500 is folded to form the outer box 1650 (FIG. 16). In at least one example embodiment, the adhesive is applied to the third side panel 1025 (and/or the first side panel 1015), where the third side panel 1025 is then connected to the first side panel 1015. In at least one example embodiment, the blank 1500 does not require an adhesive to close and seal a lower portion or an upper portion of the outer box 1650.

In at least one example embodiment, and as shown in FIGS. 16 and 17, once the outer box 1650 is assembled, the outer box 1650 can hold one or more of the inserts 100. In at least one example embodiment, the upper portion of the outer box 1650 is re-closeable by virtue of the tuck panel 1520 being accessible (FIG. 16) to allow the top panel 1525 to be opened and subsequently re-closed, as the inserts 100 are removed from the outer box 1650.

In at least one example embodiment, the blank 1000 (FIG. 10) and/or the blank 1500 (FIG. 15) are made from a single web of material. In at least one example embodiment, the blank 1000 and/or the blank 1500 are made from cardboard, paper, paperboard, other suitable packaging materials, or combinations thereof. In at least one example embodiment, the blank 1000 and/or the blank 1500 are made from a layer or layers of material. In at least one example embodiment, the layer or layers of material may include a foil layer. In at least one example embodiment, the outer box 1100 and/or the outer box 1650 are made according to the method disclosed in U.S. Pat. No. 10,407,208.

In at least one example embodiment, the outer box 1100 and/or the outer box 1650 can retain three inserts 100. In at least one example embodiment, the outer box 1100 and/or the outer box 1650 can retain one insert 100, or more than one insert 100.

In at least one example embodiment, the blank 1000, the blank 1500, the outer box 1100 and/or the outer box 1650 are made from recyclable materials.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

What is claimed is:

1. An insert, comprising:

a base, the base including at least one depression that defines a cavity, the at least one depression including a floor with walls, the walls including a first pair of opposing walls and a second pair of opposing walls, the first pair of opposing walls each defining an undercut, the undercut including a first arcuate-shaped segment and an upper inclined segment that join at an apex, the apex of the undercut for each of the first pair of opposing walls facing each other, the first arcuate-shaped segment being inclined to extend upward and further into a central-portion of the cavity, the upper inclined segment being inclined to extend upward and further away from the central-portion of the cavity, each of the first pair of opposing walls including a second arcuate-shaped segment that is between and is directly connected to the upper inclined segment and an upper brim of the base, the second arcuate-shaped segment extending upward and further away from the central-portion of the cavity, a crease being defined along an inner surface of the at least one depression at a seam between the upper inclined segment and the second arcuate-shaped segment; and a lid connected to the upper brim, the lid covering the cavity.

2. The insert of claim 1, wherein the first arcuate-shaped segment defines a first interior surface of the at least one depression that is concave, the upper inclined segment defines a second interior surface of the at least one depression that is flat, and the second arcuate-shaped segment defines a third interior surface of the at least one depression that is convex.

3. The insert of claim 1, wherein major interior surfaces of the first pair of opposing walls is flared outward, from the floor of the at least one depression to the upper brim of the base, such that the first pair of opposing walls are closest together at the floor.

4. The insert of claim 1, wherein the first pair of opposing walls is longer than the second pair of opposing walls.

5. The insert of claim 4, wherein the at least one depression has a horizontal cross-sectional shape that is rectangular.

6. The insert of claim 1, wherein the undercut for each of the first pair of opposing walls extends from an upper portion of each of the first pair of opposing walls into the cavity.

7. The insert of claim 6, wherein the undercut for each of the first pair of opposing walls runs along half of a first length of each of the first pair of opposing walls.

8. The insert of claim 1, wherein the base includes a first flat major surface on the upper brim of the base, the lid including a second flat major surface, at least a portion of the second flat major surface being at least partially connected to the first flat major surface.

9. The insert of claim 1, wherein the base includes a first flat major surface on the upper brim of the base, the lid including a second flat major surface, the second flat major surface covering and being connected to the first flat major surface.

10. The insert of claim 1, wherein the lid includes a weakened area, the weakened area being at least partially above the cavity.

11. The insert of claim 10, wherein the weakened area is a thinned portion of the lid.

12. The insert of claim 10, wherein the weakened area is defined at least in part by perforation lines in the lid.

13. The insert of claim 10, wherein the cavity is configured to contain a consumer product, and the at least one depression is configured to be pressed toward the lid to push the consumer product through the weakened area to release the consumer product from the insert.

14. The insert of claim 13, wherein the base is made from a thermoform plastic, and the walls of the at least one depression have a thickness of 0.4 mm to 0.6 mm.

15. The insert of claim 13, wherein the base is made from polyethylene terephthalate, and the walls of the at least one depression have a thickness of 0.5 mm.

16. The insert of claim 13, wherein each one of the first pair of opposing walls has a lower corner that is rounded, the lower corner being connected to the floor of the at least one depression.

17. The insert of claim 16, wherein the first pair of opposing walls define opposing concave interior surfaces of the at least one depression, each one of the opposing concave interior surfaces including an inner surface of the first arcuate-shaped segment and the lower corner.

18. The insert of claim 17, wherein the opposing concave interior surfaces are configured to securely hold side surfaces of a consumer product.

19. The insert of claim 1, wherein the first pair of opposing walls are flared outward away from each other from a lowest elevation to a highest elevation of the at least one depression, such that the first pair of opposing walls are closest to each other at the floor of the at least one depression.

20. The insert of claim 1, wherein the first pair of opposing walls are flared outward away from each other from a lowest elevation to a highest elevation of the at least one depression, such that the first pair of opposing walls are closest to each other at the floor of the at least one depression, and the second pair of opposing walls are flared outward away from each other from the lowest elevation the highest elevation of the at least one depression, such that the second pair of opposing walls are closest to each other at the floor of the at least one depression.

21. The insert of claim 1, wherein the at least one depression includes a plurality of depressions.

22. The insert of claim 1, further comprising:

a cartridge contained within the at least one depression.

23. The insert of claim 22, wherein an upper surface of an upper end of the cartridge is at a first elevation that is higher than a second elevation of the apex of the undercut for each of the first pair of opposing walls.

24. The insert of claim 22, wherein the cartridge has a maximum width that spans between a respective one of the first pair of opposing walls, the apex of the first pair of opposing walls being separated by a first distance, the maximum width being larger than the first distance.

25. The insert of claim 24, wherein the first distance is at least 90% of the maximum width.

26. The insert of claim 24, wherein the cartridge has a first horizontal cross-section with a rectangular shape and a first vertical cross-section with opposing convex outer sidewalls, the opposing convex outer sidewalls being in direct contact with at least a portion of the first pair of opposing walls of the at least one depression, the maximum width existing in a plane that traverses through a mid-section of the opposing convex outer sidewalls of the cartridge.

27. The insert of claim 22, wherein the cartridge has a first horizontal cross-section with a rectangular shape and a first vertical cross-section with opposing convex outer sidewalls, the opposing convex outer sidewalls being in direct contact with at least a portion of the first pair of opposing walls of the at least one depression.

28. The insert of claim 27, wherein the cartridge is free-floating in a first direction within the at least one depression, the first direction being perpendicular to interior surfaces of the second pair of opposing walls.

29. The insert of claim 27, wherein the cartridge has a second vertical cross-section that is perpendicular to the first vertical cross-section, the second vertical cross-section having second opposing sidewalls that are flat, the cartridge being free-floating in a first direction within the at least one depression such that both of the second pair of opposing walls are not in direct contact with the second opposing sidewalls at a same time.

30. The insert of claim 27, wherein the first pair of opposing walls defines opposing lower concave interior surfaces of the at least one depression, and the floor and the opposing lower concave interior surfaces of the at least one depression are in direct contact with lower portions of the cartridge.

31. The insert of claim 30, wherein the lower portions of the cartridge include side surfaces and a lower surface of the cartridge that are at or below a mid-section of the cartridge, the mid-section being in a plane that passes through a maximum width of the cartridge, the maximum width spanning between the first pair of opposing walls.

32. The insert of claim 31, wherein the first arcuate-shaped segment of the undercut is in direct contact with upper portions of the cartridge, the upper portions including upper side surfaces of the cartridge that are at or above the mid-section of the cartridge.

33. The insert of claim 32, wherein upper interior surfaces of the first pair of opposing walls, other than the first arcuate-shaped segment, are spaced apart and do not directly contact the upper portions of the cartridge.

34. A package, comprising:

a plurality of inserts, each one of the inserts being identical to the insert of claim 1; and an outer box containing the plurality of inserts.

35. The package of claim 34, further comprising:

a cartridge contained within the at least one depression of each of the plurality of inserts.

36. The package of claim 34, wherein the outer box includes an opening that is re-closeable, the outer box being configured to allow each one of the plurality of inserts to be slideably removed from outer box through the opening.

37. The insert of claim 3, further comprising:

a cartridge contained within the at least one depression, wherein the cartridge has a first vertical cross-section with opposing convex outer sidewalls, and the opposing convex outer sidewalls are in direct contact with at least a portion of the first pair of opposing walls of the at least one depression, the cartridge being free-floating in a first direction within the at least one depression, the first direction being perpendicular to interior surfaces of the second pair of opposing walls.

* * * * *